US008830149B2

(12) United States Patent
Yamamoto et al.

(10) Patent No.: US 8,830,149 B2
(45) Date of Patent: Sep. 9, 2014

(54) DISPLAY DEVICE

(75) Inventors: Tetsuro Yamamoto, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 711 days.

(21) Appl. No.: 12/475,227

(22) Filed: May 29, 2009

(65) Prior Publication Data

US 2009/0322730 A1 Dec. 31, 2009

(30) Foreign Application Priority Data

Jun. 25, 2008 (JP) ..... 2008-165203

(51) Int. Cl.

| | |
|---|---|
| ***G09G 3/30*** | (2006.01) |
| ***G09G 3/32*** | (2006.01) |
| ***G09G 3/36*** | (2006.01) |

(52) U.S. Cl.

CPC ..... *G09G 3/3258* (2013.01); *G09G 2310/0262* (2013.01); *G09G 3/3233* (2013.01); *G09G 2300/0426* (2013.01); *G09G 3/3659* (2013.01); *G09G 2300/0819* (2013.01); *G09G 3/3266* (2013.01)

USPC ..... 345/78; 345/76

(58) Field of Classification Search

USPC ..... 345/76–83, 204–215, 690–699; 315/169.1–169.4

See application file for complete search history.

(56) References Cited

U.S. PATENT DOCUMENTS

| | | | | |
|---|---|---|---|---|
| 7,071,911 | B2 * | 7/2006 | Inukai | 345/92 |
| 7,212,183 | B2 * | 5/2007 | Tobita | 345/93 |
| 8,040,298 | B2 * | 10/2011 | Choi | 345/76 |
| 2003/0193490 | A1 * | 10/2003 | Liu et al. | 345/204 |
| 2004/0189627 | A1 * | 9/2004 | Shirasaki et al. | 345/204 |
| 2005/0024305 | A1 * | 2/2005 | Park | 345/82 |
| 2006/0132668 | A1 * | 6/2006 | Park et al. | 349/48 |
| 2006/0170624 | A1 * | 8/2006 | Yumoto et al. | 345/76 |
| 2006/0170628 | A1 * | 8/2006 | Yamashita et al. | 345/76 |
| 2006/0227081 | A1 * | 10/2006 | Joo et al. | 345/76 |
| 2007/0040770 | A1 * | 2/2007 | Kim | 345/76 |
| 2008/0030436 | A1 * | 2/2008 | Iida et al. | 345/77 |
| 2008/0117146 | A1 * | 5/2008 | Iida et al. | 345/76 |
| 2008/0123002 | A1 * | 5/2008 | Yeh | 349/37 |
| 2008/0143648 | A1 * | 6/2008 | Ishizuka et al. | 345/76 |
| 2009/0184911 | A1 * | 7/2009 | Fukutome | 345/92 |

FOREIGN PATENT DOCUMENTS

| | | |
|---|---|---|
| JP | 2006-215213 | 8/2006 |
| JP | 2006-255213 | 8/2006 |
| JP | 2007-286453 | 11/2007 |
| JP | 2007-316455 | 12/2007 |
| JP | 2008-158189 | 7/2008 |
| JP | 2009-204664 | 9/2009 |
| JP | 2009-244526 | 10/2009 |

* cited by examiner

*Primary Examiner* — Patrick F Marinelli

(74) *Attorney, Agent, or Firm* — Rader, Fishman & Grauer PLLC

(57) ABSTRACT

Disclosed herein is a display device that allows a vertical scanning line to be shared between a plurality of rows without increasing the number of control lines or control signals, the display device including pixel circuits; vertical scanning lines; and horizontal scanning lines.

11 Claims, 20 Drawing Sheets

DISPLAY DEVICE

The present application contains subject matter related to that disclosed in Japanese priority Patent Application JP 2008-165203 filed in the Japan Patent Office on Jun. 25, 2008, the entire content of which is hereby incorporated by reference.

BACKGROUND OF THE INVENTION

1. Field of the Invention

The present invention relates to a display device having a pixel circuit (referred to also as a pixel) provided with an electrooptic element (referred to also as a display element or a light emitting element), and particularly to a display device having a current-driven type electrooptic element changing in luminance according to the magnitude of a driving signal as a display element, and having an active element in each pixel circuit, display driving being performed in a pixel unit by the active element.

2. Description of the Related Art

There are display devices that use an electrooptic element changing in luminance according to a voltage applied to the electrooptic element or a current flowing through the electrooptic element as a display element of a pixel. For example, a liquid crystal display element is a typical example of an electrooptic element that changes in luminance according to a voltage applied to the electrooptic element, and an organic electroluminescence (hereinafter described as organic EL) element (organic light emitting diode (OLED)) is a typical example of an electrooptic element that changes in luminance according to a current flowing through the electrooptic element. An organic EL display device using the latter organic EL element is a so-called emissive display device using a self-luminous electrooptic element as a display element of a pixel.

The organic EL element includes an organic thin film (organic layer) formed by laminating an organic hole transporting layer and an organic light emitting layer between a lower electrode and an upper electrode. The organic EL element is an electrooptic element using a phenomenon of light emission occurring on application of an electric field to the organic thin film. A color gradation is obtained by controlling the value of current flowing through the organic EL element.

The organic EL element can be driven by a relatively low application voltage (for example 10V or lower), and thus consumes low power. In addition, the organic EL element is a self-luminous element that emits light by itself, and therefore obviates a need for an auxiliary illuminating member such as a backlight desired in a liquid crystal display device. Thus the organic EL element facilitates reduction in weight and thickness. Further, the organic EL element has a very high response speed (for example a few μs or so), so that no afterimage occurs at a time of displaying a moving image. Because the organic EL element has these advantages, flat-panel emissive display devices using the organic EL element as an electrooptic element have recently been actively developed.

Display devices using an electrooptic element including liquid crystal display devices using a liquid crystal display element and organic EL display devices using an organic EL element can adopt a simple (passive) matrix system and an active matrix system as a driving system of the display devices. However, while having a simple structure, a simple matrix type display device presents for example a problem of difficulty in realizing a large and high-definition display device.

Thus an active matrix system that controls a pixel signal supplied to a light emitting element within a pixel by using an active element similarly provided within the pixel, for example an insulated gate field effect transistor (typically a thin film transistor (TFT)) as a switching transistor has recently been actively developed.

When an electrooptic element within a pixel circuit is made to emit light, an input image signal supplied via a video signal line is captured into a storage capacitor (referred to also as a pixel capacitance) provided to the gate terminal (control input terminal) of a driving transistor by a switching transistor (referred to as a sampling transistor), and a driving signal corresponding to the captured input image signal is supplied to the electrooptic element.

In a liquid crystal display device using a liquid crystal display element as an electrooptic element, because the liquid crystal display element is a voltage-driven type element, the liquid crystal display element is driven by a voltage signal itself corresponding to an input image signal captured into a storage capacitor. On the other hand, in an organic EL display device using a current-driven type element such as an organic EL element or the like as an electrooptic element, a driving transistor converts a driving signal (voltage signal) corresponding to an input image signal captured into a storage capacitor into a current signal, and the driving current is supplied to the organic EL element or the like.

The current-driven type electrooptic element typified by the organic EL element varies in light emission luminance when the value of the driving current varies. Hence, in order to make the electrooptic element emit light at stable luminance, it is important to supply stable driving current to the electrooptic element. For example, a driving system for supplying the driving current to the organic EL element can be roughly classified into a constant-current driving system and a constant-voltage driving system (which are well known techniques, so that publicly known documents will not be presented here).

Because the voltage-current characteristic of the organic EL element has a steep slope, when constant-voltage driving is performed, slight variations in voltage or variations in element characteristic cause great variations in current and thus bring about great variations in luminance. Hence, constant-current driving in which the driving transistor is used in a saturation region is generally used. Of course, even with constant-current driving, changes in current invite variations in luminance. However, small variations in current cause only small variations in luminance.

Conversely, even with the constant-current driving system, in order for the light emission luminance of the electrooptic element to be unchanged, it is important for the driving signal written to the storage capacitor according to the input image signal and retained by the storage capacitor to be constant. For example, in order for the light emission luminance of the organic EL element to be unchanged, it is important for the driving current corresponding to the input image signal to be constant.

However, the threshold voltage and mobility of the active element (driving transistor) driving the electrooptic element vary due to process variations. In addition, characteristics of the electrooptic element such as the organic EL element or the like vary with time. Such variations in the characteristics of the active element for driving and such variations in the characteristics of the electrooptic element affect light emission luminance even in the case of the constant-current driving system.

Thus, various mechanisms for correcting luminance variations caused by the above-described variations in the characteristics of the active element for driving and the electrooptic element within each pixel circuit are being studied to uniformly control the light emission luminance over the entire screen of a display device.

For example, a mechanism described in Japanese Patent Laid-Open No. 2006-215213 (hereinafter referred to as Patent Document 1) as a pixel circuit for an organic EL element has a threshold value correcting function for holding driving current constant even when there is a variation or a secular change in threshold voltage of a driving transistor, a mobility correcting function for holding the driving current constant even when there is a variation or a secular change in mobility of the driving transistor, and a bootstrap function for holding the driving current constant even when there is a secular change in current-voltage characteristic of the organic EL element.

On the other hand, when consideration is given to cost reduction, reducing the number of scanning lines drawn out from various scanning circuits provided on the periphery of a pixel array section without reducing the number of pixels is considered. At this time, pixels of a plurality of columns are assigned to one horizontal scanning line, or pixels of a plurality of rows are assigned to one vertical scanning line, whereby a scanning signal output from a scanning circuit is shared by the plurality of pixels.

When the number of scanning lines arranged within the pixel array section is reduced, cost reduction can be achieved by the cost of circuitry for driving each scanning line. At this time, adopting a mechanism that reduces the number of pieces of extraction wiring without reducing the number of pixels, which mechanism is proposed in a liquid crystal display device, is considered. For example, directing attention to a horizontal scanning side, adopting a mechanism for achieving cost reduction by sharing a signal line between a plurality of pixels is considered (see Japanese Patent Laid-Open No. 2006-251322 (hereinafter referred to as Patent Document 2), for example).

The mechanism described in Patent Document 2 is a system in which a signal line is shared by adjacent pixels and a video signal is rewritten by inputting two video signals to one pixel.

SUMMARY OF THE INVENTION

However, the mechanism described in Patent Document 2 may not be adopted into a mechanism that makes mobility correction by performing signal writing while passing current when driving a current-driven type electrooptic element. This is because when a video signal voltage is input to the gate of a driving transistor twice or more, mobility correction is made for the first video signal, and mobility correcting operation may not be performed normally for the video signal input to the gate of the driving transistor for the second time or thereafter.

The mechanism described in Patent Document 1 desires wiring for supplying potential for correction, a switching transistor for correction, and a pulse for switching which pulse drives the switching transistor. The mechanism described in Patent Document 1 employs a 5TR driving configuration when a driving transistor and a sampling transistor are included, so that the configuration of a pixel circuit is complex with a large number of vertical scanning lines and the like. Many constituent elements of the pixel circuit hinder achievement of higher definition of the display device. As a result, it is difficult to apply the 5TR driving configuration to a display device used in a small electronic device such as a portable device (mobile device) or the like.

There is thus a desire to develop a mechanism that simplifies a pixel circuit and further reduces the number of scanning lines. At this time, consideration should be given to preventing a new problem that does not occur with the 5TR driving configuration from occurring with the reduction of the number of scanning lines and the simplification of the pixel circuit.

The present invention has been made in view of the above situation. First, it is desirable to provide a mechanism that directing attention to a vertical scanning system, allows a vertical scanning line and a vertical scanning signal to be shared between a plurality of pixels (that is, a plurality of rows) without increasing the number of control lines or control signals.

Further, it is desirable to provide a mechanism that makes it possible to achieve higher definition of a display device by simplifying a pixel circuit. In addition, it is desirable to provide a mechanism that can suppress luminance change due to variations in characteristics of a driving transistor and an electrooptic element in simplifying a pixel circuit.

In order to share a vertical scanning line between a plurality of pixels (that is, a plurality of rows), one form of a display device according to the present invention includes a pixel array section having pixel circuits arranged in a form of a matrix, the pixel circuits each including a driving transistor for generating a driving current, an electrooptic element connected to an output terminal of the driving transistor, a storage capacitor for retaining information corresponding to signal amplitude of a video signal, and a first sampling transistor and a second sampling transistor for writing the information corresponding to the signal amplitude to the storage capacitor, the first sampling transistor and the second sampling transistor being cascaded, the driving current based on the information retained by the storage capacitor being generated and passed through the electrooptic element, whereby the electrooptic element emits light.

The pixel array section further includes vertical scanning lines connected to a vertical scanning section configured to generate a vertical scanning pulse for vertical scanning of the pixel circuits and horizontal scanning lines connected to a horizontal scanning section configured to supply the video signal to the pixel circuits (the first and second sampling transistors to be exact) so as to coincide with the vertical scanning in the vertical scanning section.

Further, the vertical scanning section has at least a writing scanning section configured to generate a writing scanning pulse for vertically scanning the pixel circuits and write the information corresponding to the signal amplitude to the storage capacitor, and has writing scanning lines connected to the writing scanning section as the vertical scanning lines, the writing scanning lines each being arranged so as to commonly supply a writing driving pulse for vertical scanning from the writing scanning section to control input terminals of first sampling transistors in a plurality of rows. Further, in each group of the plurality of rows sharing the writing scanning line, control input terminals of second sampling transistors are connected to vertical scanning lines so as to be supplied from the vertical scanning section with vertical scanning pulses for vertical scanning of a same kind or different kinds in respective different rows of another group other than a group to which the own rows belong.

That is, to share a scanning line and a scanning signal of a vertical scanning system between a plurality of rows, the vertical scanning line to be shared is handled as a writing scanning line, and first a sampling transistor is formed into a so-called double-gate structure of a two-stage connected configuration. Then, for first sampling transistors, the writing scanning line to be shared is commonly connected to control input terminals of first sampling transistors of the plurality of rows so as to be shared between the plurality of rows.

On the other hand, second sampling transistors are connected to vertical scanning lines of a same kind or different kinds of respective different rows of another group other than a shared group to which the own rows belong so that the video signal is supplied to the control input terminal of the driving transistor by a combination of the first sampling transistor and the second sampling transistor so as to coincide with ordinary vertical scanning of each row. Incidentally, the "different kinds" does not mean that all vertical scanning lines connected to the control input terminals of the second sampling transistors within the group are of different kinds, but means that the control input terminals of the respective second sampling transistors within the group are connected to at least two kinds of vertical scanning lines.

In accordance with this, on the side of the horizontal scanning section, for each group of the plurality of rows sharing the writing scanning line, the video signal for each row is sequentially changed and supplied to pixel circuits so as to coincide with vertical scanning in the vertical scanning section. On the side of the vertical scanning section, vertical scanning pulses of a same kind or different kinds are set such that the first sampling transistors are vertically scanned by the writing driving pulse, and within the group sharing the writing scanning pulse, a display process is performed in order by making one of the second sampling transistors conduct in order so as to coincide with the conduction of the first sampling transistors in a total display process period from a start of a display process period of one of the sharing rows to completion of a display process of all the rows.

The "display process" means a process relating to image display in an emission period. The display process includes for example a signal writing process for retaining information corresponding to the signal amplitude of the video signal in the storage capacitor, a threshold value correcting process for making the storage capacitor retain a voltage corresponding to the threshold voltage of the driving transistor and a preparatory process for the threshold value correcting process, and a mobility correcting process for suppressing the dependence of the driving current on the mobility of the driving transistor. Incidentally, in a period in which the second sampling transistors do not need to be made to conduct in order, the vertical scanning section sets the vertical scanning pulses such that a display process as usual (for example the threshold value correcting process and the preparatory process for the threshold value correcting process correspond to the display process) is performed by making both of the first and second sampling transistors conduct.

According to one form of the present invention, the sampling transistor is formed into a double-gate structure, and a writing scanning line to be shared is assigned as a vertical scanning line for controlling first sampling transistors, whereby one writing scanning line is shared by pixel circuits of a plurality of rows. On the other hand, as vertical scanning lines for controlling second sampling transistors, existing vertical scanning lines of a same kind or different kinds of respective different rows of another group other than the shared group to which the own rows belong are assigned.

Thus, cost reduction can be achieved by sharing a writing scanning line of vertical scanning lines and a writing driving pulse supplied to pixel circuits via the writing scanning line between pixel circuits of a plurality of rows without increasing the number of control lines or control signals.

DETAILED DESCRIPTION OF THE PREFERRED EMBODIMENTS

Preferred embodiments of the present invention will hereinafter be described in detail with reference to the drawings.

<General Outline of Display Device>

Figure 1:
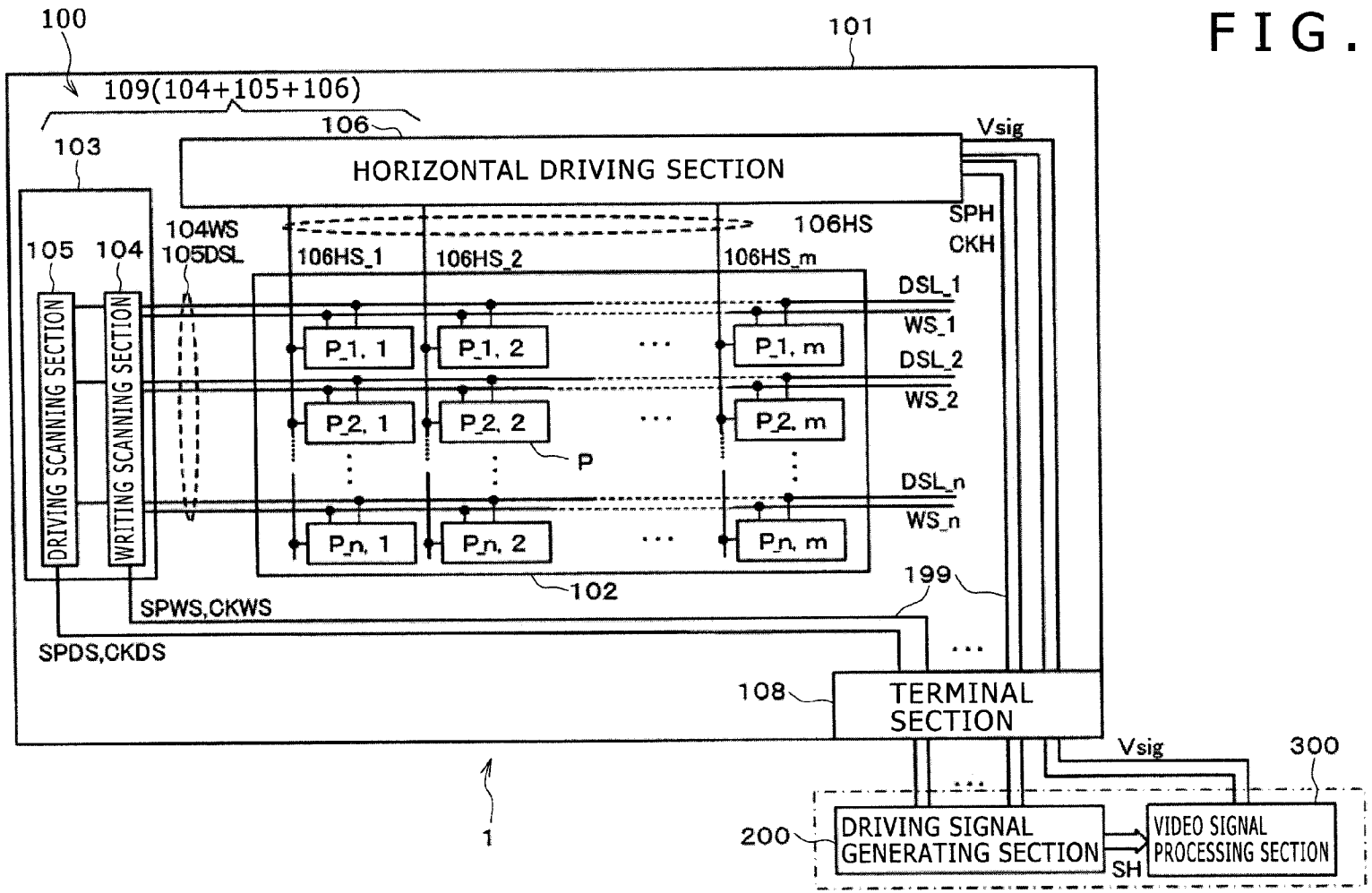
FIG. 1 is a block diagram showing an outline of a configuration of an active matrix type display device as an embodiment of a display device according to the present invention.

FIG. 1 is a block diagram showing an outline of a configuration of an active matrix type display device as an embodiment of a display device according to the present invention. The present embodiment will be described by taking as an example a case where the present invention is applied to an active matrix type organic EL display (hereinafter referred to as an "organic EL display device") using for example an organic EL element as a display element (an electrooptic element or a light emitting element) of a pixel and a polysilicon thin film transistor (TFT) as an active element, the organic EL element being formed on a semiconductor substrate where the thin film transistor is formed. Such an organic EL display device is used as a display section of a portable type music player using a recording medium such as a semiconductor memory, a minidisc (MD), a cassette tape or the like and other electronic devices.

Incidentally, while concrete description will be made in the following by taking the organic EL element as an example of the display element of the pixel, the organic EL element is an example, and the display element of interest is not limited to the organic EL element. All embodiments to be described later are similarly applicable to all display elements that generally emit light by being driven by current.

As shown in FIG. 1, the organic EL display device 1 includes: a display panel section 100 in which pixel circuits (referred to also as pixels) P having organic EL elements (not shown) as a plurality of display elements are arranged so as to form an effective video area having a mode ratio of X:Y (for example 9:16) as a display aspect ratio; a driving signal generating section 200 as an example of a panel controlling section that issues various pulse signals for driving and controlling the display panel section 100; and a video signal processing section 300. The driving signal generating section 200 and the video signal processing section 300 are included in an IC (integrated circuit) on a single chip.

For example, the whole of the panel type display device is generally formed with a pixel array section 102 in which elements forming the pixel circuits such as TFTs and electrooptic elements are arranged in the form of a matrix, a controlling section 109 having as a main part thereof a scanning section (a horizontal driving section and a vertical driving section) disposed on the periphery of the pixel array section 102 and connected to scanning lines for driving each pixel circuit P, and the driving signal generating section 200 and the video signal processing section 300 that generate various signals for operating the controlling section 109.

On the other hand, a product form is not limited to the provision of the organic EL display device 1 in the form of a module (composite part) having all of the display panel section 100, the driving signal generating section 200, and the video signal processing section 300 though the display panel section 100 having the pixel array section 102 and the controlling section 109 on a same substrate 101 (glass substrate) is separate from the driving signal generating section 200 and the video signal processing section 300, as shown in FIG. 1. It is possible to include the pixel array section 102 in the display panel section 100 and provide merely the display panel section 100 as the organic EL display device 1. In this case, peripheral circuits such as the controlling section 109, the driving signal generating section 200, and the video signal processing section 300 are mounted on a substrate (for example flexible substrate) separate from the organic EL display device 1 formed by the display panel section 100 alone (which form will be referred to as a peripheral circuit extra-panel arrangement configuration).

In the case of an on-panel arrangement configuration where the display panel section 100 is formed by mounting the pixel array section 102 and the controlling section 109 on the same substrate 101, a mechanism (referred to as a TFT integrated configuration) in which each TFT for the controlling section 109 (and the driving signal generating section 200 and the video signal processing section 300 as desired) is formed simultaneously in a process of forming TFTs of the pixel array section 102 may be adopted, or a mechanism (referred to as a COG mounting configuration) in which a semiconductor chip for the controlling section 109 (and the driving signal generating section 200 and the video signal processing section 300 as desired) is directly mounted on the substrate 101 having the pixel array section 102 mounted thereon by COG (Chip On Glass) mounting technology may be adopted.

The display panel section 100 includes for example the pixel array section 102 in which the pixel circuits P are arranged in the form of a matrix of n rows×m columns, a vertical driving unit 103 as an example of a vertical scanning section configured to scan the pixel circuits P in a vertical direction, a horizontal driving section (referred to also as a horizontal selector or a data line driving section) 106 as an example of a horizontal scanning section configured to scan the pixel circuits P in a horizontal direction, and a terminal section (pad section) 108 for external connection, the pixel array section 102, the vertical driving unit 103, the horizontal driving section 106, and the terminal section 108 being formed in an integrated manner on the substrate 101. That is, peripheral driving circuits such as the vertical driving unit 103 and the horizontal driving section 106 are formed on the same substrate 101 as the pixel array section 102.

The vertical driving unit 103 includes for example a writing scanning section (write scanner WS; Write Scan) 104 and a driving scanning section (drive scanner DS; Drive Scan) 105 functioning as a power scanner having a power supplying capability. The vertical driving unit 103 and the horizontal driving section 106 form the controlling section 109 configured to control the writing of a signal potential to a storage capacitor, threshold value correcting operation, mobility correcting operation, and bootstrap operation.

While the configuration of the vertical driving unit 103 and corresponding scanning lines is shown so as to be adapted to a case where the pixel circuits P are of a 2TR configuration according to the present embodiment to be described later, another scanning section may be provided depending on the configuration of the pixel circuits P.

As an example, the pixel array section 102 is driven by the writing scanning section 104 and the driving scanning section 105 from one side or both sides in the horizontal direction shown in FIG. 1, and is driven by the horizontal driving section 106 from one side or both sides in the vertical direction shown in FIG. 1.

The terminal section 108 is supplied with various pulse signals from the driving signal generating section 200 disposed outside the organic EL display device 1. In addition, the terminal section 108 is similarly supplied with a video signal Vsig from the video signal processing section 300. When color display is supported, video signals Vsig_R, Vsig_G, and Vsig_B for respective colors (three primary colors of R (red), G (green), and B (blue) in the present example) are supplied.

For example, necessary pulse signals such as shift start pulses SPDS and SPWS as an example of writing start pulses in the vertical direction and vertical scanning clocks CKDS and CKWS are supplied as pulse signals for vertical driving. In addition, necessary pulse signals such as a horizontal start pulse SPH as an example of a writing start pulse in the horizontal direction and a horizontal scanning clock CKH are supplied as pulse signals for horizontal driving.

Each terminal of the terminal section 108 is connected to the vertical driving unit 103 and the horizontal driving section 106 via wiring 199. For example, each pulse supplied to the terminal section 108 is internally adjusted in voltage level by a level shifter section not shown in the figure as desired, and thereafter supplied to each section of the vertical driving unit 103 and the horizontal driving section 106 via a buffer.

Though not shown in the figure (details will be described later), the pixel array section 102 has a constitution in which the pixel circuits P having a pixel transistor provided for the organic EL element as a display element are two-dimensionally arranged in the form of a matrix, a vertical scanning line is arranged for each row of the pixel arrangement, and a signal line (an example of a horizontal scanning line) is arranged for each column of the pixel arrangement.

For example, each scanning line on a vertical scanning side (vertical scanning line: a writing scanning line 104WS and a power supply line 105DSL) and a video signal line (data line) 106HS as a scanning line on a horizontal scanning side (horizontal scanning line) are formed in the pixel array section 102. The organic EL element not shown in the figure and a thin film transistor (TFT) for driving the organic EL element are formed at intersections of the respective scanning lines of the vertical scanning and the horizontal scanning. The pixel circuits P are formed with a combination of the organic EL element and the thin film transistor.

Specifically, writing scanning lines 104WS_1 to 104WS_n for n rows which scanning lines are driven by a writing driving pulse WS by the writing scanning section 104 and power supply lines 105DSL_1 to 105DSL_n for the n rows which power supply lines are driven by a power driving pulse DSL by the driving scanning section 105 are arranged in each pixel row of the pixel circuits P arranged in the form of a matrix.

The writing scanning section 104 and the driving scanning section 105 sequentially select each pixel circuit P via the writing scanning line 104WS and the power supply line 105DSL on the basis of the pulse signals for the vertical driving system which signals are supplied from the driving signal generating section 200. The horizontal driving section 106 samples a predetermined potential of the video signal Vsig and writes the predetermined potential to the storage capacitor of a selected pixel circuit P via the video signal line 106HS on the basis of the pulse signals for the horizontal driving system which signals are supplied from the driving signal generating section 200.

The organic EL display device 1 according to the present embodiment is capable of line-sequential driving, frame-sequential driving, or driving of another system. For example, the writing scanning section 104 and the driving scanning section 105 of the vertical driving unit 103 scan the pixel array section 102 in row units, and in synchronism with this, the horizontal driving section 106 simultaneously writes image signals for one horizontal line to the pixel array section 102.

The horizontal driving section 106 includes for example a driver circuit for simultaneously turning on switches not shown in the figure which switches are provided on the video signal lines 106HS of all the columns. The horizontal driving section 106 simultaneously turns on the switches not shown in the figure which switches are provided on the video signal lines 106HS of all the columns to simultaneously write an image signal input from the video signal processing section 300 to all pixel circuits P of one line of a row selected by the vertical driving unit 103. Thus the video signal Vsig (an example of a horizontal scanning signal) is supplied to the horizontal scanning line (video signal line 106HS) via the driver circuit.

Each section of the vertical driving unit 103 is formed by a combination of logic gates (including a latch) and a driver circuit. The pixel circuits P of the pixel array section 102 are selected in row units by the logic gates, and a vertical scanning signal is supplied to the vertical scanning line via the driver circuit. Incidentally, while FIG. 1 shows a configuration in which the vertical driving unit 103 is disposed on only one side of the pixel array section 102, a configuration in which the vertical driving unit 103 is disposed on both a left side and a right side with the pixel array section 102 interposed between the left side and the right side may be adopted. Similarly, while FIG. 1 shows a configuration in which the horizontal driving section 106 is disposed on only one side of the pixel array section 102, a configuration in which the horizontal driving section 106 is disposed on both an upper side and a lower side with the pixel array section 102 interposed between the upper side and the lower side may be adopted.

As is understood from the connection mode of the vertical driving unit 103 (the writing scanning section 104 and the driving scanning section 105), the horizontal driving section 106, the vertical scanning line (the writing scanning line 104WS and the power supply line 105DSL), and the horizontal scanning line (the video signal line 106HS), scanning lines are necessary to supply a scanning signal to each pixel circuit P of the pixel array section 102. In a simple mechanism, when the number of pixel circuits P is increased, the number of scanning lines is correspondingly increased, and the driver circuits for driving the scanning lines are also increased. While FIG. 1 shows a form in which scanning lines are arranged for each row and each column for convenience, a mechanism according to the present embodiment to be described later reduces the number of scanning lines (writing scanning lines 104WS in particular) while maintaining the number of pixels.

<Pixel Circuit>

Figure 2:
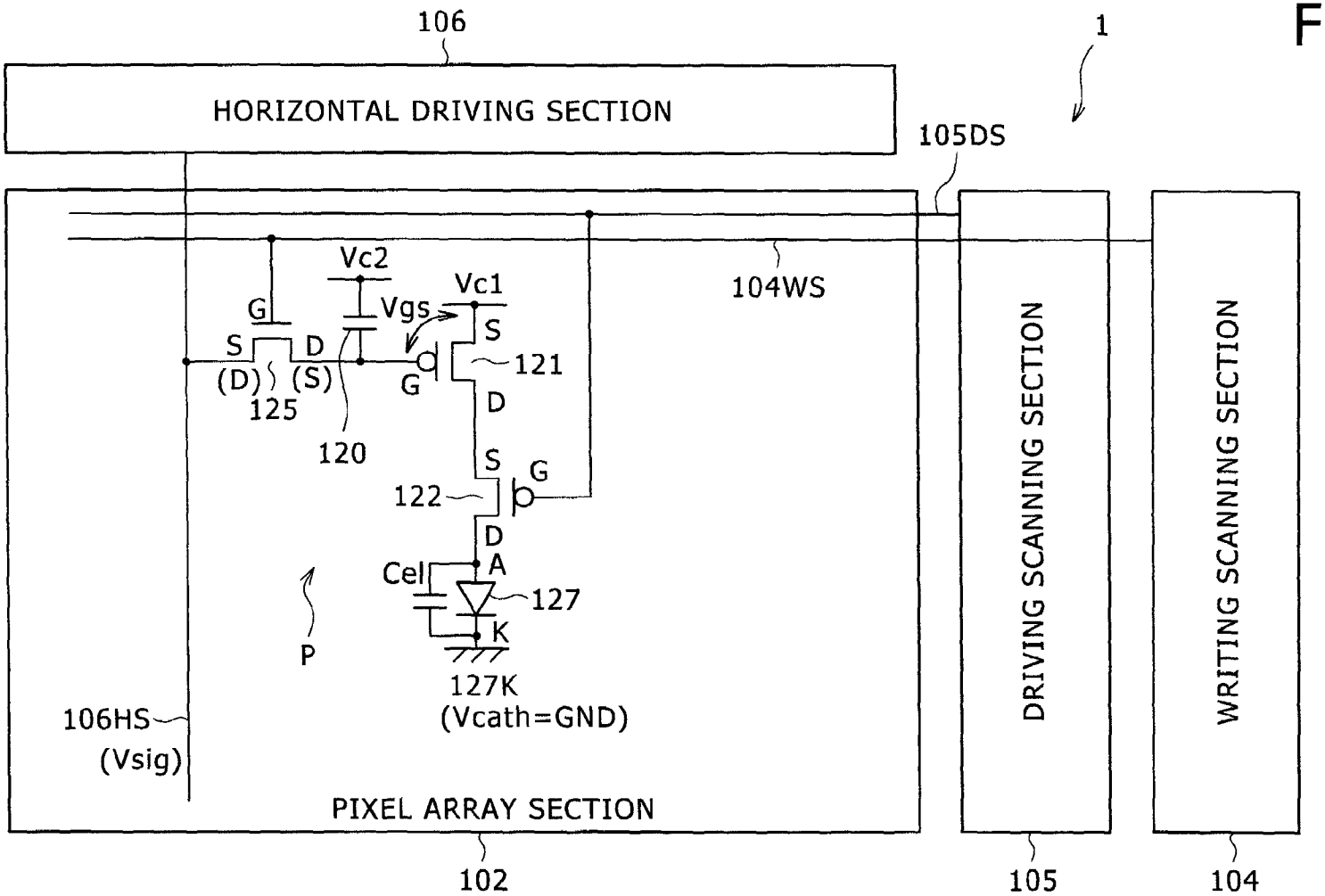
FIG. 2 is a diagram showing a first comparative example for pixel circuits according to the present embodiment.
Figure 3:
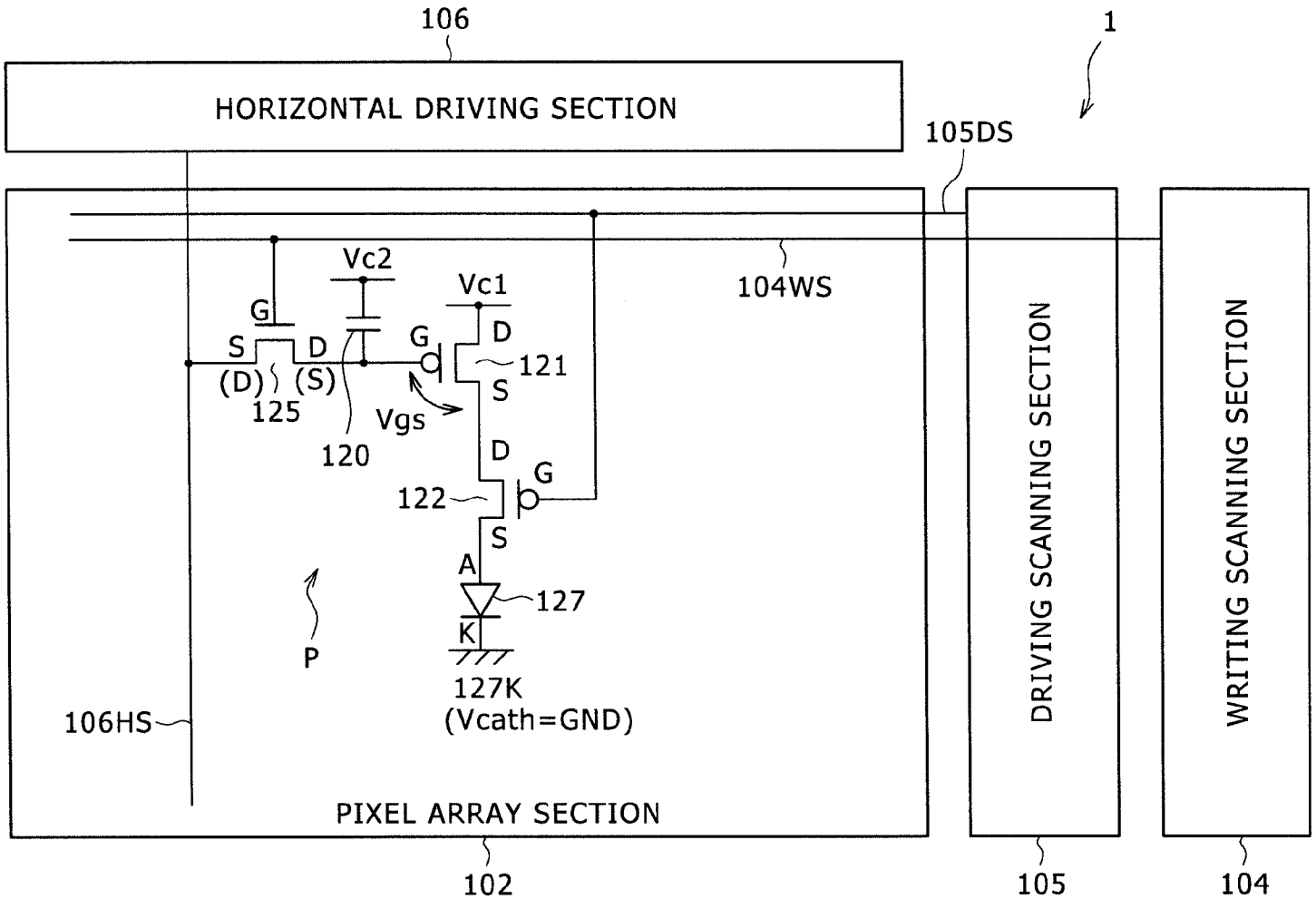
FIG. 3 is a diagram showing a second comparative example for the pixel circuits according to the present embodiment.
Figure 4:
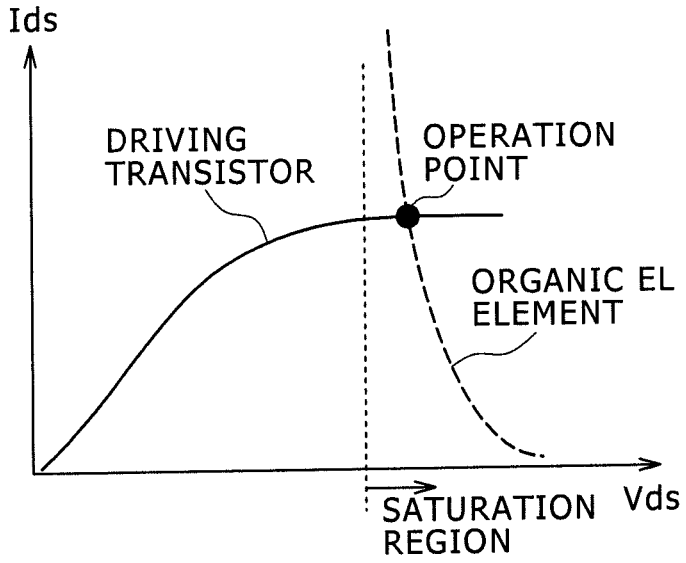
FIG. 4 is a diagram of assistance in explaining an operating point of an organic EL element and a driving transistor.
Figure 5A:
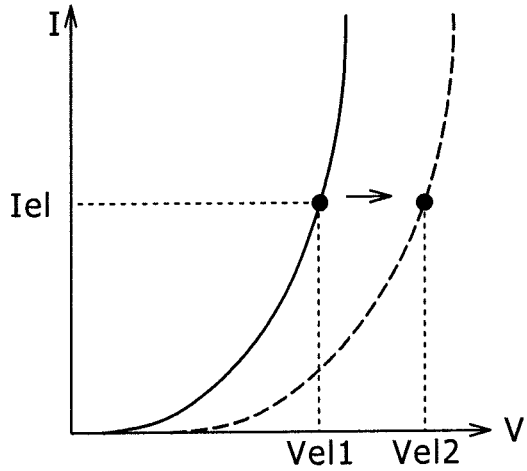
FIGS. 5A to 5C are diagrams of assistance in explaining effects of variations in characteristics of the organic EL element and the driving transistor on a driving current.
Figure 5B:
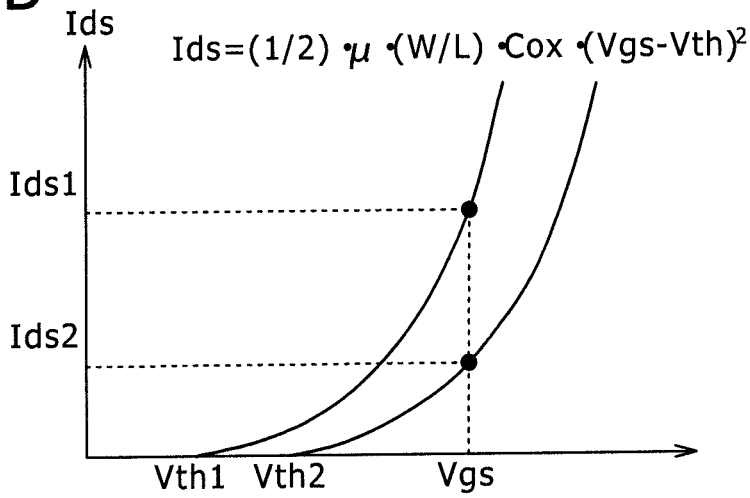
Figure 5C:
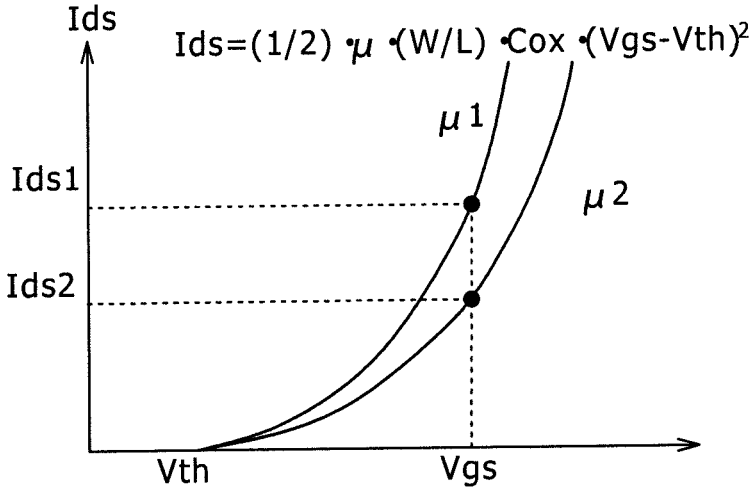

FIG. 2 is a diagram showing a first comparative example for the pixel circuits P according to the present embodiment forming the organic EL display device 1 shown in FIG. 1. Incidentally, FIG. 2 also shows the vertical driving unit 103 and the horizontal driving section 106 disposed in the peripheral part of the pixel circuits P on the substrate 101 of the display panel section 100. FIG. 3 is a diagram showing a second comparative example for the pixel circuits P according to the present embodiment. Incidentally, FIG. 3 also shows the vertical driving unit 103 and the horizontal driving section 106 disposed in the peripheral part of the pixel circuits P on the substrate 101 of the display panel section 100. FIG. 4 is a diagram of assistance in explaining an operating point of an organic EL element and a driving transistor. FIGS. 5A to 5C are diagrams of assistance in explaining effects of variations in characteristics of the organic EL element and the driving transistor on a driving current Ids.

Figure 6:
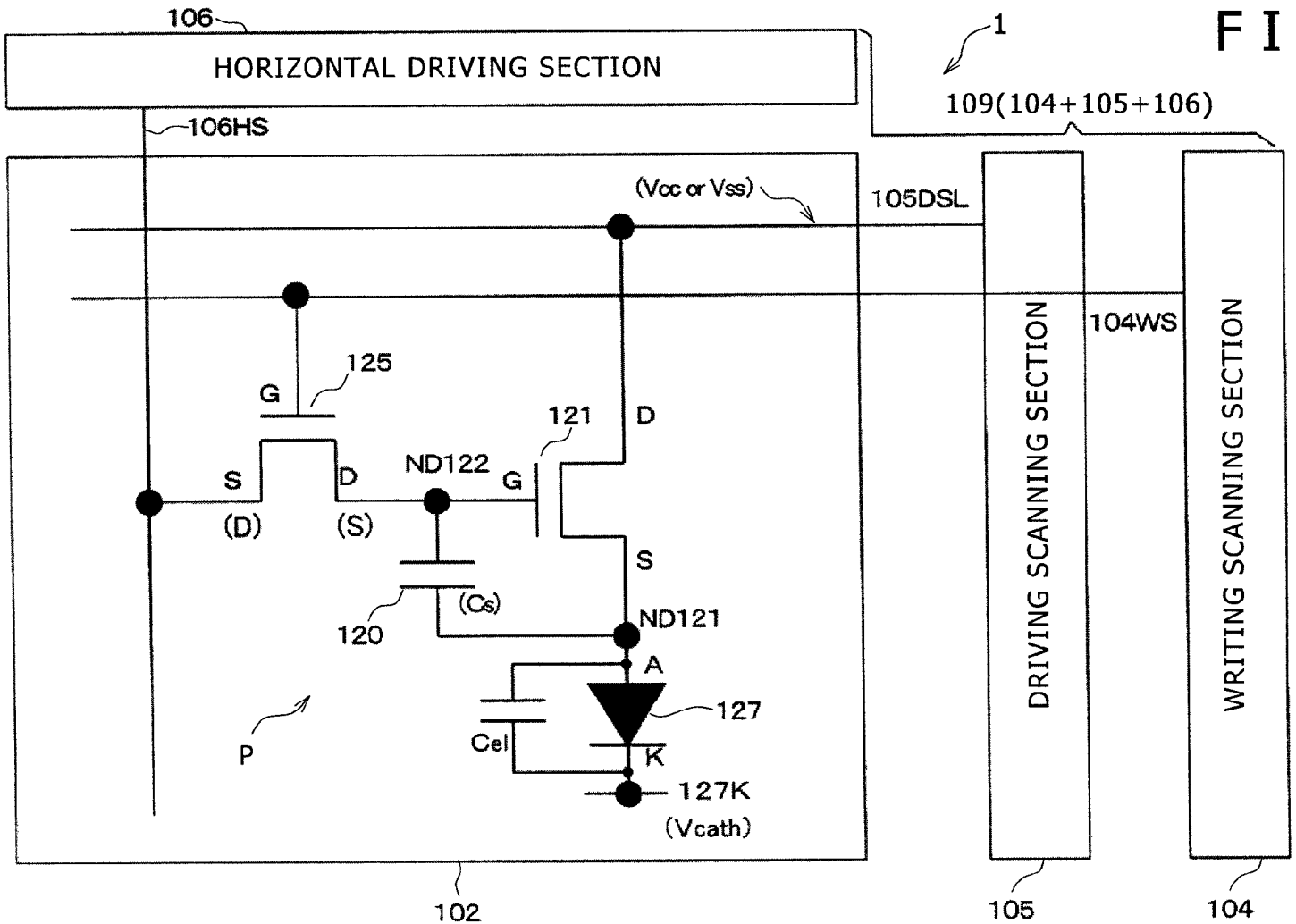
FIG. 6 is a diagram showing a third comparative example for the pixel circuits according to the present embodiment.

FIG. 6 is a diagram showing a third comparative example for the pixel circuits P according to the present embodiment. Incidentally, FIG. 6 also shows the vertical driving unit 103 and the horizontal driving section 106 disposed in the peripheral part of the pixel circuits P on the substrate 101 of the display panel section 100. An EL driving circuit in the pixel circuit P according to the present embodiment to be described later is based on an EL driving circuit including at least a storage capacitor 120 and a driving transistor 121 in a pixel circuit P according to the third comparative example. In this sense, it may safely be said that the pixel circuit P according to the third comparative example effectively has a similar circuit structure to that of the EL driving circuit in the pixel circuit P according to the present embodiment.

First Example

Pixel Circuit of Comparative Example

As shown in FIG. 2, the pixel circuit P according to the first comparative example is basically defined in that a driving transistor is formed by a p-type thin film field-effect transistor (TFT). In addition, the pixel circuit P according to the first comparative example employs a 3Tr driving configuration using two transistors for scanning in addition to the driving transistor.

Specifically, the pixel circuit P according to the first comparative example includes the p-type driving transistor 121, a p-type light emission controlling transistor 122 supplied with an active-L driving pulse, an n-type transistor 125 supplied with an active-H driving pulse, an organic EL element 127 as an example of an electrooptic element (light emitting element) that emits light by being fed with a current, and a storage capacitor (referred to also as a pixel capacitance) 120. Incidentally, a simplest circuit can employ a 2Tr driving configuration from which the light emission controlling transistor 122 is removed. In this case, the organic EL display device 1 employs a configuration from which the driving scanning section 105 is removed.

The driving transistor 121 supplies the organic EL element 127 with a driving current corresponding to a potential supplied to a gate terminal as a control input terminal of the driving transistor 121. The organic EL element 127 generally has a rectifying property, and is therefore represented by the symbol of a diode. Incidentally, the organic EL element 127 has a parasitic capacitance Cel. In FIG. 2, the parasitic capacitance Cel is shown in parallel with the organic EL element 127.

The sampling transistor 125 is a switching transistor disposed on the side of the gate terminal (control input terminal) of the driving transistor 121. The light emission controlling transistor 122 is also a switching transistor. Incidentally, in general, the sampling transistor 125 can be replaced with a p-type supplied with an active-L driving pulse. The light emission controlling transistor 122 can be replaced with an n-type supplied with an active-H driving pulse.

A pixel circuit P is disposed at an intersection of scanning lines 104WS and 105DS on a vertical driving side and a video signal line 106HS as a scanning line on a horizontal scanning side. The writing scanning line 104WS from the writing scanning section 104 is connected to the gate terminal of the sampling transistor 125. The driving scanning line 105DS from the driving scanning section 105 is connected to the gate terminal of the light emission controlling transistor 122.

The sampling transistor 125 has a source terminal S as a signal input terminal connected to the video signal line 106HS, and has a drain terminal D as a signal output terminal connected to the gate terminal G of the driving transistor 121. The storage capacitor 120 is disposed between a point of connection between the drain terminal D of the sampling transistor 125 and the gate terminal G of the driving transistor 121 and a second power supply potential Vc2 (which is for example a positive power supply voltage, and may be the same as a first power supply potential Vc1). As shown in parentheses, the source terminal S and the drain terminal D of the sampling transistor 125 can be interchanged with each other so that the drain terminal D is connected as a signal input terminal to the video signal line 106HS and the source terminal S is connected as a signal output terminal to the gate terminal G of the driving transistor 121.

The driving transistor 121, the light emission controlling transistor 122, and the organic EL element 127 are connected in series with each other in this order between the first power supply potential Vc1 (for example a positive power supply voltage) and a ground potential GND as an example of a reference potential. Specifically, the driving transistor 121 has a source terminal S connected to the first power supply potential Vc1, and has a drain terminal D connected to the source terminal S of the light emission controlling transistor 122. The drain terminal D of the light emission controlling transistor 122 is connected to the anode terminal A of the organic EL element 127. The cathode terminal K of the organic EL element 127 is connected to cathode common wiring 127K common to all pixels. The cathode common wiring 127K is set to the ground potential GND, for example. In this case, a cathode potential Vcath is also the ground potential GND.

Incidentally, as a simpler configuration, a simplest circuit can employ a 2Tr driving configuration formed by removing the light emission controlling transistor 122 in the configuration of the pixel circuit P shown in FIG. 2. In this case, the organic EL display device 1 employs a configuration from which the driving scanning section 105 is removed.

In either of the 3Tr driving shown in FIG. 2 and the 2Tr driving not shown in the figure, because the organic EL element 127 is a current light emitting element, a color gradation is obtained by controlling an amount of current flowing through the organic EL element 127. As such, the value of the current flowing through the organic EL element 127 is controlled by changing a voltage applied to the gate terminal of the driving transistor 121 and thereby changing a gate-to-source voltage Vgs retained by the storage capacitor 120. At this time, the potential of the video signal Vsig supplied from the video signal line 106HS (video signal line potential) is a signal potential. Incidentally, suppose that a signal amplitude indicating a gradation is ΔVin.

When the writing scanning line 104WS is set in a selected state by supplying the active-H writing driving pulse WS to the writing scanning line 104WS from the writing scanning section 104, and a signal potential is applied from the horizontal driving section 106 to the video signal line 106HS, the n-type transistor 125 conducts, the signal potential becomes the potential of the gate terminal of the driving transistor 121, and information corresponding to the signal amplitude ΔVin is written to the storage capacitor 120. A current flowing through the driving transistor 121 and the organic EL element 127 has a value corresponding to the gate-to-source voltage Vgs of the driving transistor 121, the gate-to-source voltage Vgs being retained by the storage capacitor 120, and the organic EL element 127 continues to emit light at a luminance corresponding to the value of the current. The operation of transmitting the video signal Vsig supplied to the video signal line 106HS to the inside of the pixel circuit P by selecting the writing scanning line 104WS is referred to as "writing" or "sampling." Once the signal is written, the organic EL element 127 continues to emit light at a fixed luminance until the signal is rewritten next.

In the pixel circuit P according to the first comparative example, the value of the current flowing through the organic EL element 127 is controlled by changing the applied voltage supplied to the gate terminal of the driving transistor 121 according to the signal amplitude ΔVin. At this time, the source terminal of the p-type driving transistor 121 is connected to the first power supply potential Vc1, and the driving transistor 121 typically operates in a saturation region.

Second Example

Pixel Circuit of Comparative Example

A pixel circuit P according to the second comparative example shown in FIG. 3 will next be described as a comparative example in describing characteristics of the pixel circuit P according to the present embodiment. The pixel circuit P according to the second comparative example (as with the present embodiment to be described later) is basically defined in that a driving transistor is formed by an n-type thin film field-effect transistor. When each transistor can be formed as an n-type rather than a p-type, an existing amorphous silicon (a-Si) process can be used in transistor production. Thereby, the transistor substrate can be reduced in cost. The development of pixel circuits P of such a constitution is anticipated.

The pixel circuit P according to the second comparative example is basically the same as the present embodiment to be described later in that a driving transistor is formed by an n-type thin film field-effect transistor. However, the pixel circuit P according to the second comparative example is not provided with a driving signal constancy achieving circuit for preventing effects of variation (variations and secular changes) in characteristics of the organic EL element 127 and the driving transistor 121 on the driving current Ids.

Specifically, the pixel circuit P according to the second comparative example is formed by simply replacing the p-type driving transistor 121 in the pixel circuit P according to the first comparative example with an n-type driving transistor 121 and arranging the light emission controlling transistor 122 and the organic EL element 127 on the source terminal side of the driving transistor 121. Incidentally, the light emission controlling transistor 122 is also replaced by an n-type. Of course, a simplest circuit can employ a 2Tr driving configuration from which the light emission controlling transistor 122 is removed.

In the pixel circuit P according to the second comparative example, irrespective of whether the light emission controlling transistor is provided or not, when the organic EL element 127 is driven, the drain terminal side of the driving transistor 121 is connected to the first power supply potential Vc1, and the source terminal of the driving transistor 121 is connected to the anode terminal side of the organic EL element 127, whereby a source follower circuit is formed as a whole.

<Relation to Iel-Vel Characteristic of Electrooptic Element>

Generally, as shown in FIG. 4, the driving transistor 121 is driven in a saturation region where the driving current Ids is constant irrespective of the gate-to-source voltage. Hence, letting Ids be the current flowing between the drain terminal and the source of the transistor operating in the saturation region, μ be mobility, W be channel width (gate width), L be channel length (gate length), Cox be gate capacitance (gate oxide film capacitance per unit area), and Vth be the threshold voltage of the transistor, the driving transistor 121 is a constant-current source having a value as shown in the following Equation (1). Incidentally, "A" denotes a power. As is clear from Equation (1), the drain current Ids of the transistor in the saturation region is controlled by the gate-to-source voltage Vgs, and the driving transistor 121 operates as a constant-current source.

$$Ids = \frac{1}{2}\mu\frac{W}{L}Cox(Vgs - Vth)\text{^}2 \quad (1)$$

However, the I-V characteristic of a current-driven type light emitting element including the organic EL element generally changes with the passage of time as shown in FIG. 5A. In the current-voltage (Iel-Vel) characteristics of a current-driven type light emitting element typified by the organic EL element shown in FIG. 5A, a curve shown as a solid line indicates a characteristic at a time of an initial state, and a curve shown as a broken line indicates a characteristic after a secular change.

For example, when a light emission current Iel flows through the organic EL element 127 as an example of a light emitting element, a voltage between the anode and the cathode of the organic EL element 127 is uniquely determined. However, as shown in FIG. 5A, during an emission period, the light emission current Iel determined by the drain-to-source current Ids (=driving current Ids) of the driving transistor 121 flows through the anode terminal of the organic EL element 127, and thereby rises by an amount corresponding to the anode-to-cathode voltage Vel of the organic EL element 127.

In the pixel circuit P according to the first comparative example shown in FIG. 2, effect of the rise corresponding to the anode-to-cathode voltage Vel of the organic EL element 127 appears on the drain terminal side of the driving transistor 121. However, because the driving transistor 121 performs constant-current driving by operating in the saturation region, a constant current Ids flows through the organic EL element 127, and a secular change does not occur in the light emission luminance of the organic EL element 127 even when the Iel-Vel characteristic of the organic EL element 127 changes.

The configuration of the pixel circuit P in the connection mode shown in FIG. 2 which pixel circuit includes the driving transistor 121, the light emission controlling transistor 122, the storage capacitor 120, and the sampling transistor 125 has a driving signal constancy achieving circuit formed therein for holding the driving current constant by correcting a change in the current-voltage characteristic of the organic EL element 127 as an example of an electrooptic element. That is, when the pixel circuit P is driven by the video signal Vsig, the source terminal of the p-type driving transistor 121 is connected to the first power supply potential Vc1, and the p-type driving transistor 121 is designed to operate in the saturation region at all times. Therefore the p-type driving transistor 121 is a constant-current source having the value as shown in Equation (1).

In the pixel circuit P according to the first comparative example, the voltage of the drain terminal of the driving transistor 121 changes with a secular change in the Iel-Vel characteristic of the organic EL element 127 (FIG. 5A). However, because the gate-to-source voltage Vgs of the driving transistor 121 is held constant in principle by the bootstrap function of the storage capacitor 120, the driving transistor 121 operates as a constant-current source. As a result, a constant amount of current flows through the organic EL element 127, and the organic EL element 127 can be made to emit light at a constant luminance, so that the light emission luminance is unchanged.

Also in the pixel circuit P according to the second comparative example, the potential of the source terminal (source potential Vs) of the driving transistor 121 is determined by the operating point of the driving transistor 121 and the organic EL element 127, and the driving transistor 121 is driven in the saturation region. The driving transistor 121 therefore feeds the driving current Ids having the current value defined in the above-described Equation (1) in relation to the gate-to-source voltage Vgs corresponding to the source voltage of the operating point.

However, in the simple circuit (pixel circuit P according to the second comparative example) formed by changing the p-type driving transistor 121 in the pixel circuit P according to the first comparative example to an n-type, the source terminal is connected to the side of the organic EL element 127. As a result, according to the Iel-Vel characteristic of the organic EL element 127 which characteristic changes with the passage of time as shown in FIG. 5A described above, the anode-to-cathode voltage Vel for the same light emission current Iel changes from Vel1 to Vel2, whereby the operating point of the driving transistor 121 is changed, and the source potential Vs of the driving transistor 121 is changed even when the same gate potential Vg is applied. Thereby the gate-to-source voltage Vgs of the driving transistor 121 is changed. As is clear from Characteristic Equation (1), when the gate-to-source voltage Vgs is varied, the driving current Ids is varied even when the gate potential Vg is constant. The variation in driving current Ids due to this cause appears as a variation or a secular change in light emission luminance of each pixel circuit P, thus causing degradation in image quality.

On the other hand, as will be described later in detail, even in the case of using the n-type driving transistor 121, a circuit configuration and driving timing for realizing a bootstrap function that makes the potential Vg of the gate terminal of the driving transistor 121 interlocked with variation in the potential Vs of the source terminal of the driving transistor 121 can vary the gate potential Vg so as to cancel variation in anode potential of the organic EL element 127 (that is, variation in source potential of the driving transistor 121) due to a secular change in the characteristic of the organic EL element 127 even when the variation in anode potential of the organic EL element 127 occurs. Thereby, the uniformity of screen luminance can be ensured. The bootstrap function can improve the capability of correcting secular variation of a current-driven type light emitting element typified by the organic EL element. Of course, this bootstrap function operates when the source potential Vs of the driving transistor 121 varies with variation in the anode-to-cathode voltage Vel in a process of the light emission current Iel starting flowing through the organic EL element 127 at a time of a start of light emission and thereby the anode-to-cathode voltage Vel rising until the anode-to-cathode voltage Vel becomes stable.

<Relation to Vgs-Ids Characteristic of Driving Transistor>

Although the characteristics of the driving transistor 121 are not regarded as a particular problem in the first and second comparative examples, when a characteristic of the driving transistor 121 differs in each pixel, the characteristic affects the driving current Ids flowing through the driving transistor 121. As an example, as is understood from Equation (1), when the mobility μ or the threshold voltage Vth varies or changes with the passage of time between pixels, a variation or a secular change occurs in the driving current Ids flowing through the driving transistor 121 even when the gate-to-source voltage Vgs is the same, and thus the light emission luminance of the organic EL element 127 changes in each pixel.

For example, there are variations in characteristics such as the threshold voltage Vth, the mobility μ and the like in each pixel circuit P due to variations in a manufacturing process of the driving transistor 121. Even in the case where the driving transistor 121 is driven in the saturation region, the drain current (driving current Ids) varies in each pixel circuit P due to the characteristic variations even when a same gate potential is supplied to the driving transistor 121, and the variation in the drain current appears as variation in light emission luminance.

As described above, the drain current Ids when the driving transistor 121 is operating in the saturation region is expressed by Characteristic Equation (1). Directing attention to variation in threshold voltage of the driving transistor 121, as is clear from Characteristic Equation (1), a variation in the threshold voltage Vth varies the drain current Ids even when the gate-to-source voltage Vgs is constant. In addition, directing attention to variation in mobility of the driving transistor 121, as is clear from Characteristic Equation (1), a variation in the mobility μ varies the drain current Ids even when the gate-to-source voltage Vgs is constant.

When a large difference in the Vgs-Ids characteristic thus occurs due to difference in threshold voltage Vth or mobility μ, the driving current Ids is varied and the light emission luminance becomes different even when the same signal amplitude ΔVin is given. Therefore the uniformity of screen luminance may not be obtained. On the other hand, driving timing for realizing a threshold value correcting function and a mobility correcting function (details will be described later) can suppress effects of these variations, and ensure the uniformity of screen luminance.

In threshold value correcting operation and mobility correcting operation adopted in the present embodiment, when a writing gain is assumed to be one (ideal value), the gate-to-source voltage Vgs at a time of light emission is set so as to be expressed by "ΔVin+Vth−ΔV", whereby the drain-to-source current Ids is not dependent on variation or change in the threshold voltage Vth and is not dependent on variation or change in the mobility μ. As a result, even when the threshold voltage Vth or the mobility μ varies due to a manufacturing process or with the passage of time, the driving current Ids is not varied, and the light emission luminance of the organic EL element 127 is not varied either. At a time of mobility correction, negative feedback is applied such that a mobility correcting parameter ΔV1 is increased for a high mobility μ1, whereas a mobility correcting parameter ΔV2 is decreased for a low mobility μ2. In this sense, the mobility correcting parameter ΔV is referred to also as an amount of negative feedback ΔV.

Third Example

Pixel Circuit of Comparative Example

The pixel circuit P according to the third comparative example shown in FIG. 6, on which circuit the pixel circuit P according to the present embodiment is based, employs a driving system that incorporates a circuit (bootstrap circuit) for preventing variation in driving current due to a secular change of the organic EL element 127 in the pixel circuit P according to the second comparative example shown in FIG. 3, and which driving system prevents variation in driving current due to variation in the characteristics of the driving transistor 121 (variations in threshold voltage and variations in mobility).

As with the pixel circuit P according to the second comparative example, the pixel circuit P according to the third comparative example uses an n-type driving transistor 121. In addition, the pixel circuit P according to the third comparative example is defined in that the pixel circuit P according to the third comparative example has a circuit for suppressing variation in driving current Ids to the organic EL element due to a secular change of the organic EL element, that is, a driving signal constancy achieving circuit for holding the driving current Ids constant by correcting a change in the current-voltage characteristic of the organic EL element as an example of an electrooptic element. Further, the pixel circuit P according to the third comparative example is defined in that the pixel circuit P according to the third comparative example has a function of making the driving current constant even when a secular change occurs in the current-voltage characteristic of the organic EL element.

That is, the pixel circuit P according to the third comparative example is defined in that the pixel circuit P according to the third comparative example employs a 2TR driving configuration using one switching transistor (sampling transistor 125) for scanning in addition to the driving transistor 121, and prevents effects of a secular change of the organic EL element 127 and variations in the characteristics of the driving transistor 121 (for example variations and changes in threshold voltage and mobility) on the driving current Ids by setting on/off timing (switching timing) of a power driving pulse DSL and a writing driving pulse WS for controlling each switching transistor. The 2TR driving configuration as well as a small number of elements and a small number of pieces of wiring makes it possible to achieve higher definition.

The pixel circuit P according to the third comparative example greatly differs from the second comparative example shown in FIG. 3 in terms of configuration in that the connection mode of a storage capacitor 120 is modified to form a bootstrap circuit, which is an example of a driving signal constancy achieving circuit, as a circuit for preventing variation in driving current due to a secular change of the organic EL element 127. A provision is made by devising the driving timing of the transistors 121 and 125 as a method of suppressing effects of variations in the characteristics of the driving transistor 121 (for example variations and changes in threshold voltage and mobility) on the driving current Ids.

Specifically, the pixel circuit P according to the third comparative example includes the storage capacitor 120, the n-type driving transistor 121, the n-type transistor 125 supplied with an active-H (high) writing driving pulse WS, and the organic EL element 127 as an example of an electrooptic element (light emitting element) that emits light by being fed with a current.

The storage capacitor 120 is connected between the gate terminal (node ND122) and the source terminal of the driving transistor 121. The source terminal of the driving transistor 121 is directly connected to the anode terminal of the organic EL element 127. The storage capacitor 120 also functions as a bootstrap capacitance. As in the first comparative example and the second comparative example, the cathode terminal of the organic EL element 127 is connected to cathode common wiring 127K common to all pixels, and is supplied with a cathode potential Vcath (for example a ground potential GND).

The drain terminal of the driving transistor 121 is connected to a power supply line 105DSL from a driving scanning section 105 functioning as a power supply scanner. The power supply line 105DSL is defined in that the power supply line 105DSL itself has a capability of supplying power to the driving transistor 121.

Specifically, the driving scanning section 105 has a power supply voltage changing circuit for selecting each of a first potential Vcc on a high voltage side corresponding to a power supply voltage and a second potential Vss on a low voltage side, and supplying the potential to the drain terminal of the driving transistor 121.

Suppose that the second potential Vss is sufficiently lower than the offset potential Vofs (referred to also as a reference potential) of a video signal Vsig in a video signal line 106HS. Specifically, the second potential Vss on the low potential side of the power supply line 105DSL is set such that the gate-to-source voltage Vgs (a difference between a gate potential Vg and a source potential Vs) of the driving transistor 121 is larger than the threshold voltage Vth of the driving transistor 121. Incidentally, the offset potential Vofs is used for initializing operation prior to threshold value correcting operation, and is also used to precharge the video signal line 106HS.

The sampling transistor 125 has a gate terminal connected to a writing scanning line 104WS from a writing scanning section 104, has a drain terminal connected to the video signal line 106HS, and has a source terminal connected to the gate terminal (node ND122) of the driving transistor 121. The gate terminal of the sampling transistor 125 is supplied with the active-H writing driving pulse WS from the writing scanning section 104.

The sampling transistor 125 can be in a connection mode in which the source terminal and the drain terminal are interchanged with each other. In addition, either of a depletion type and an enhancement type can be used as the sampling transistor 125.

Third Comparative Example

Operation of Pixel Circuit

Figure 7:
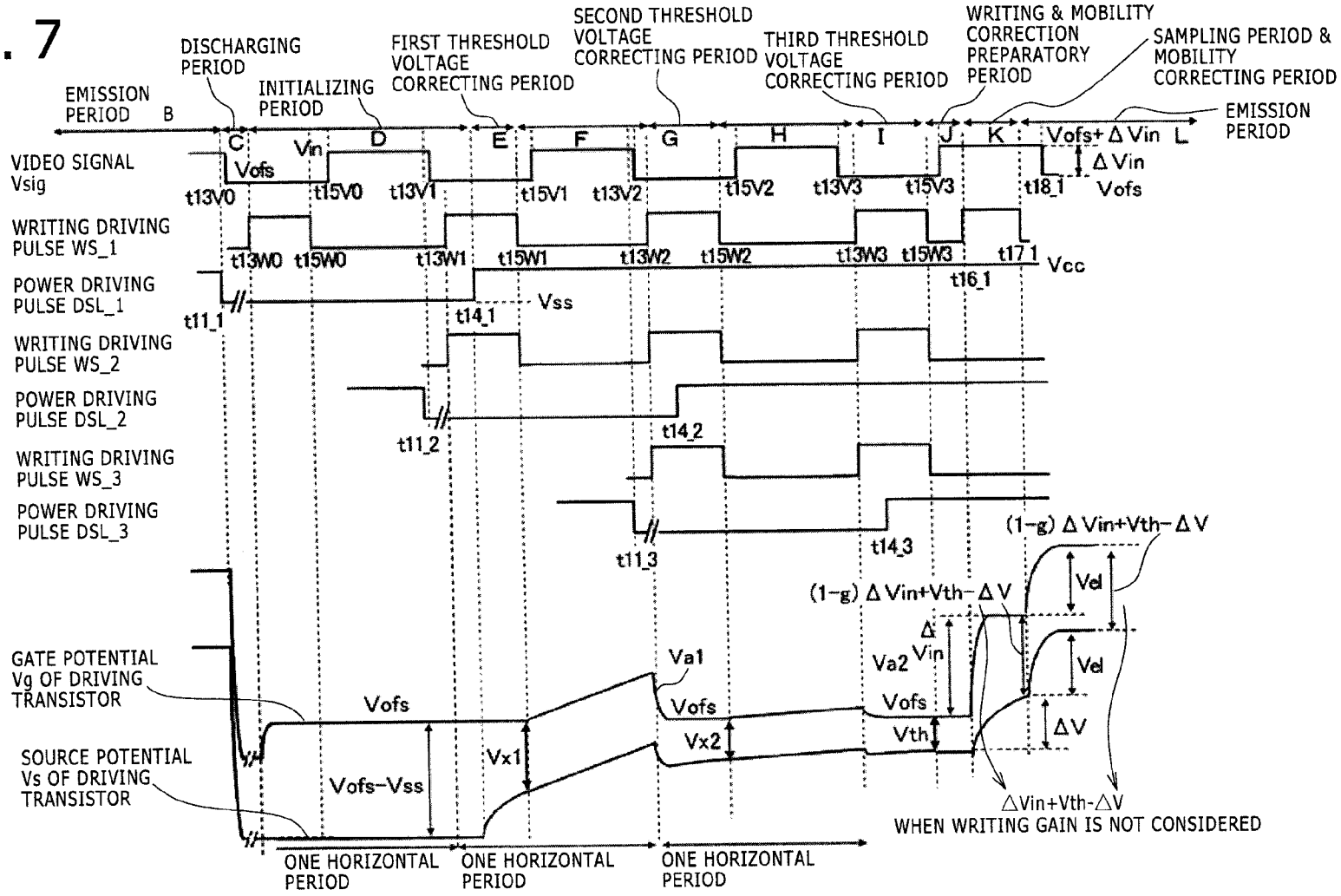
FIG. 7 is a timing chart of assistance in explaining a basic example of driving timing according to the third comparative example of a pixel circuit according to the third comparative example shown in FIG. 6.

FIG. 7 is a timing chart of assistance in explaining a basic example of driving timing according to the third comparative example of the pixel circuit P according to the third comparative example shown in FIG. 6. FIG. 7 represents a case of line-sequential driving. FIG. 7 shows changes in potential of the writing scanning line 104WS, changes in potential of the power supply line 105DSL, and changes in potential of the video signal line 106HS on a common time axis. FIG. 7 also shows changes in the gate potential Vg and the source potential Vs of the driving transistor 121 for one row (first row in the figure) in parallel with these potential changes.

The idea of the driving timing according to the third comparative example shown in FIG. 7 is applied also to the present embodiment to be described later. Incidentally, FIG. 7 shows a basic example for realizing a threshold value correcting function, a mobility correcting function, and a bootstrap function in the pixel circuit P according to the third comparative example. The driving timing for realizing the threshold value correcting function, the mobility correcting function, and the bootstrap function is not limited to the mode shown in FIG. 7, but various modifications can be made. The mechanism of each embodiment to be described later is applicable even with the driving timings of these various modifications.

The driving timing shown in FIG. 7 corresponds to the case of line-sequential driving. The writing driving pulse WS, the power driving pulse DSL, and the video signal Vsig for one row are handled as one set, and the timing (phase relation in particular) of the signals is controlled independently in a row unit. When the row is changed, the timing is shifted by one H (H is a horizontal scanning period).

In the following, to facilitate description and understanding, description will be made by briefly describing for example the writing, retaining, or sampling of information of signal amplitude ΔVin in the storage capacitor 120 assuming that a writing gain is one (ideal value) unless otherwise specified. When the writing gain is less than one, information corresponding to the magnitude of the signal amplitude ΔVin and multiplied by the gain, rather than the magnitude itself of the signal amplitude ΔVin, is retained in the storage capacitor 120.

Incidentally, the ratio of the magnitude of the information corresponding to the signal amplitude ΔVin and written to the storage capacitor 120 is referred to as a writing gain Ginput. Specifically, in a capacitive series circuit of a total capacitance C1 disposed in parallel with the storage capacitor 120 in terms of an electric circuit and including a parasitic capacitance and a total capacitance C2 disposed in series with the storage capacitor 120 in terms of an electric circuit, the writing gain Ginput relates to an amount of charge distributed to the capacitance C1 when the signal amplitude ΔVin is supplied to the capacitive series circuit. When expressed by an equation, letting g=C1/(C1+C2), Writing Gain Ginput=C2/(C1+C2)=1−C1/(C1+C2)=1−g. In the following, the writing gain is taken into consideration in a description in which "g" appears.

In addition, to facilitate description and understanding, description will be made briefly assuming that a bootstrap gain is one (ideal value) unless otherwise specified. Incidentally, a ratio of a rise in the gate potential Vg to a rise in the source potential Vs when the storage capacitor 120 is disposed between the gate and the source of the driving transistor 121 is referred to as a bootstrap gain (bootstrap operation capability) Gbst. The bootstrap gain Gbst specifically relates to the capacitance value Cs of the storage capacitor 120, the capacitance value Cgs of a parasitic capacitance C121*gs* formed between the gate and the source of the driving transistor 121, the capacitance value Cgd of a parasitic capacitance C121*gd* formed between the gate and the drain of the driving transistor 121, and the capacitance value Cws of a parasitic capacitance C125*gs* formed between the gate and the source of the sampling transistor 125. When expressed by an equation, Bootstrap Gain Gbst=(Cs+Cgs)/(Cs+Cgs+Cgd+Cws).

In the driving timing according to the third comparative example, a period in which the video signal Vsig is at the offset potential Vofs, which period is an ineffective period, is set in a first half of one horizontal period, and a period in which the video signal Vsig is at the signal potential Vin (=Vofs+ΔVin), which period is an effective period, is set in a second half of one horizontal period. In addition, threshold value correcting operation is repeated a plurality of times (three times in FIG. 7) in each horizontal period as a combination of the effective period and the ineffective period of the video signal Vsig. The timing of changing between the effective period and the ineffective period of the video signal Vsig for each of the times (t13V and t15V) and the timing of changing between an active state and an inactive state of the writing driving pulse WS (t13W and t15W) are distinguished by indicating each time by a reference element without "_."

First, in the emission period B of the organic EL element 127, the power supply line 105DSL is at the first potential Vcc, and the sampling transistor 125 is in an off state. At this time, because the driving transistor 121 is set to operate in the saturation region, the driving current Ids flowing through the organic EL element 127 assumes a value shown in Equation (1) according to the gate-to-source voltage Vgs of the driving transistor 121.

Next, when the non-emission period begins, in a first discharging period C, the power supply line 105DSL is changed to the second potential Vss. At this time, when the second potential Vss is smaller than a sum of the threshold voltage Vthel and the cathode potential Vcath of the organic EL element 127, that is, when "Vss<Vthel+Vcath", the organic EL element 127 is quenched, and the power supply line 105DSL is on the source side of the driving transistor 121. At this time, the anode of the organic EL element 127 is charged to the second potential Vss.

Further, in an initializing period D, the sampling transistor 125 is turned on when the video signal line 106HS is changed to the offset potential Vofs, so that the gate potential of the driving transistor 121 is set to the offset potential Vofs. At this time, the gate-to-source voltage Vgs of the driving transistor 121 assumes a value "Vofs−Vss." The threshold value correcting operation may not be performed unless "Vofs−Vss" is larger than the threshold voltage Vth of the driving transistor 121. It is therefore necessary that "Vofs−Vss>Vth."

When a first threshold voltage correcting period E thereafter begins, the power supply line 105DSL is changed to the first potential Vcc again. By changing the power supply line 105DSL (that is, power supply voltage to the driving transistor 121) to the first potential Vcc, the anode of the organic EL element 127 becomes the source of the driving transistor 121, and a driving current Ids flows from the driving transistor 121. Because an equivalent circuit of the organic EL element 127 is represented by a diode and a capacitance, letting Vel be an anode potential of the organic EL element 127 with respect to the cathode potential Vcath of the organic EL element 127, as long as "Vel≤Vcath+Vthel", that is, as long as a leakage current of the organic EL element 127 is considerably smaller than the current flowing through the driving transistor 121, the driving current Ids of the driving transistor 121 is used to charge the storage capacitor 120 and the parasitic capacitance Cel of the organic EL element 127. At this time, the anode voltage Vel of the organic EL element 127 rises with time.

The sampling transistor 125 is turned off after the passage of a certain time. At this time, when the gate-to-source voltage Vgs of the driving transistor 121 is larger than the threshold voltage Vth (that is, when threshold value correction is not completed), the driving current Ids of the driving transistor 121 continues flowing so as to charge the storage capacitor 120, and the gate-to-source voltage Vgs of the driving transistor 121 rises. At this time, a reverse bias is applied to the organic EL element 127, and therefore the organic EL element 127 does not emit light.

Further, in a second threshold voltage correcting period G, the sampling transistor 125 is turned on when the video signal line 106HS is changed to the offset potential Vofs again. Thereby, the gate potential of the driving transistor 121 is set to the offset potential Vofs, and the threshold value correcting operation is started again. As a result of repeating this operation, the gate-to-source voltage Vgs of the driving transistor 121 eventually assumes the value of the threshold voltage Vth. At this time, "Vel=Vofs−Vth≤Vcath+Vthel."

Incidentally, in the example of operation according to the third comparative example, the threshold value correcting operation is repeated a plurality of times with one horizontal period as a process cycle in order to make the storage capacitor 120 surely retain a voltage corresponding to the threshold voltage Vth of the driving transistor 121 by performing the threshold value correcting operation repeatedly. However, this repeated operation is not essential, but the threshold value correcting operation may be performed only once with one horizontal period as a process cycle.

After the threshold value correcting operation is completed (after a third threshold voltage correcting period I in the present example), the sampling transistor 125 is turned off, and a writing & mobility correction preparatory period J begins. When the video signal line 106HS is changed to the signal potential Vin (=Vofs+ΔVin), the sampling transistor 125 is turned on again to begin a sampling period & mobility correcting period K. The signal amplitude ΔVin is a value corresponding to a gradation. While the gate potential of the driving transistor 121 becomes the signal potential Vin (=Vofs+ΔVin) because the sampling transistor 125 is on, the drain terminal of the driving transistor 121 is at the first potential Vcc, and the driving current Ids flows, so that the source potential Vs rises with time. In FIG. 7, the amount of the rise is represented by ΔV.

At this time, when the source voltage Vs does not exceed a sum of the threshold voltage Vthel and the cathode potential Vcath of the organic EL element 127, that is, when a leakage current of the organic EL element 127 is considerably smaller than the current flowing through the driving transistor 121, the driving current Ids of the driving transistor 121 is used to charge the storage capacitor 120 and the parasitic capacitance Cel of the organic EL element 127.

At this point in time, the operation of correcting the threshold value of the driving transistor 121 is completed, and therefore the current fed by the driving transistor 121 reflects mobility μ. Specifically, when the mobility μ is high, the amount of current at this time is large, and the source rises rapidly. When the mobility μ is low, on the other hand, the amount of current is small, and the source rises slowly. Thereby, the gate-to-source voltage Vgs of the driving transistor 121 is reduced reflecting the mobility μ, and becomes a gate-to-source voltage Vgs that completely corrects the mobility μ after the passage of a certain time.

Thereafter an emission period L begins. The sampling transistor 125 is turned off to end writing, and the organic EL element 127 is allowed to emit light. Because the gate-to-source voltage Vgs of the driving transistor 121 is constant due to the bootstrap effect of the storage capacitor 120, the driving transistor 121 feeds a constant current (driving current Ids) to the organic EL element 127. The anode potential Vel of the organic EL element 127 rises to a voltage Vx at which a current as driving current Ids flows through the organic EL element 127, so that the organic EL element 127 emits light.

Also in the pixel circuit P according to the third comparative example, the I-V characteristic of the organic EL element 127 changes as light emission time is lengthened. Therefore the potential of a node ND121 (that is, the source potential Vs of the driving transistor 121) is also changed. However, because the gate-to-source voltage Vgs of the driving transistor 121 is maintained at a constant value by the bootstrap effect of the storage capacitor 120, the current flowing through the organic EL element 127 is not changed. Hence, even when the I-V characteristic of the organic EL element 127 is degraded, the constant current (driving current Ids) continues flowing through the organic EL element 127 at all times, and the luminance of the organic EL element 127 is not changed.

The relation of the driving current Ids to the gate voltage Vgs can be expressed as in Equation (2-1) by substituting "ΔVin−ΔV+Vth" for Vgs in the foregoing Equation (1) expressing a transistor characteristic. Incidentally, when the writing gain is taken into consideration, the relation of the driving current Ids to the gate voltage Vgs can be expressed as in Equation (2-2) by substituting "(1−g)ΔVin−ΔV+Vth" for Vgs in Equation (1). In Equation (2-1) and Equation (2-2) (referred to collectively as Equation (2)), k=(1/2)(W/L)Cox.

$$\left.\begin{aligned} Ids &= k\mu(Vgs - Vth)\hat{}2 = k\mu(\Delta Vin - \Delta V)\hat{}2 && (2\text{-}1) \\ Ids &= k\mu(Vgs - Vth)\hat{}2 = k\mu((1-g)\Delta Vin - \Delta V)\hat{}2 && (2\text{-}2) \end{aligned}\right\} \quad (2)$$

This Equation (2) shows that the term of the threshold voltage Vth is cancelled, and that the driving current Ids supplied to the organic EL element 127 is not dependent on the threshold voltage Vth of the driving transistor 121. The driving current Ids is basically determined by the signal amplitude ΔVin (sampling voltage=Vgs retained by the storage capacitor 120 in correspondence with the signal amplitude ΔVin, to be exact). In other words, the organic EL element 127 emits light at a luminance corresponding to the signal amplitude ΔVin.

At this time, the information retained by the storage capacitor 120 is corrected by the amount of the rise ΔV in source potential Vs. The amount of the rise ΔV acts exactly to cancel the effect of the mobility μ positioned in a coefficient part of Equation (2). The amount of correction ΔV for the mobility μ of the driving transistor 121 is added to the signal written to the storage capacitor 120. The direction of the amount of correction ΔV is actually a negative direction. In this sense, the amount of the rise ΔV is referred to also as a mobility correcting parameter ΔV or an amount of negative feedback ΔV.

The driving current Ids flowing through the organic EL element 127 is in effect dependent on only the signal amplitude ΔVin with variations in the threshold voltage Vth and mobility μ of the driving transistor 121 cancelled. Because the driving current Ids is not dependent on the threshold voltage Vth and the mobility μ, the driving current Ids between the drain and the source is not varied and the light emission luminance of the organic EL element 127 is not varied either even when the threshold voltage Vth or the mobility μ varies due to a manufacturing process or changes with the passage of time.

In addition, by connecting the storage capacitor 120 between the gate and the source of the driving transistor 121, even in the case of using the n-type driving transistor 121, a circuit configuration and driving timing for realizing a bootstrap function that makes the potential Vg of the gate terminal of the driving transistor 121 interlocked with variation in the potential Vs of the source terminal of the driving transistor 121 are set so that the gate potential Vg can be varied so as to cancel variation in anode potential of the organic EL element 127 (that is, variation in source potential of the driving transistor 121) due to a secular change in the characteristic of the organic EL element 127 even when the variation in anode potential of the organic EL element 127 occurs.

Thereby, effect of secular change in characteristic of the organic EL element 127 is eased, and the uniformity of screen luminance can be ensured. The bootstrap function of the storage capacitor 120 between the gate and the source of the driving transistor 121 can improve the capability of correcting a secular variation of a current-driven type light emitting element typified by the organic EL element. Of course, the bootstrap function operates also when the source potential Vs of the driving transistor 121 varies with variation in the anode-to-cathode voltage Vel in a process of the light emission current Iel starting flowing through the organic EL element 127 at a time of a start of light emission and thereby the anode-to-cathode voltage Vel rising until the anode-to-cathode voltage Vel becomes stable.

Thus, according to the pixel circuit P according to the third comparative example (in effect as with the pixel circuit P according to the present embodiment to be described later) and the driving timing of the controlling section 109 configured to drive the pixel circuit P, even when there occur variations (variations and secular changes) in characteristics of the driving transistor 121 or the organic EL element 127, these variations are corrected, thereby preventing effects of the variations from appearing on a display screen. Therefore high-quality image display without changes in luminance can be made.

In order to make the threshold value correcting function, the signal writing function, the mobility correcting function, and the bootstrap function work, switching control of signals to various transistors needs to be performed. For example, in order to control the pixel circuit P according to the third comparative example shown in FIG. 6 as in the driving timing shown in FIG. 7, it is necessary to perform on/off control of the sampling transistor 125, switching control of power supply to the driving transistor 121 between the first potential Vcc and the second potential Vss, and switching control of the video signal Vsig between the offset potential Vofs and the signal potential Vin (=Vofs+ΔVin). Scanning lines are necessary to supply these signals to each pixel circuit P of the pixel array section 102. When the number of pixel circuits P is increased, the number of scanning lines is correspondingly increased. From such a viewpoint, there is a desire for a mechanism that reduces the number of scanning lines while maintaining the number of pixels.

When consideration is given to reduction in cost based on the pixel circuit P according to the third comparative example described above, reducing the number of scanning lines drawn out from the controlling section 109 (the writing scanning section 104, the driving scanning section 105, and the horizontal driving section 106) provided on the periphery of the pixel array section 102 without reducing the number of pixels is first considered. When the scanning lines are reduced, cost can be reduced by the cost of circuitry for driving the scanning lines.

Fourth Example and Fifth Example

Pixel Circuit of Comparative Example

Figure 8A:
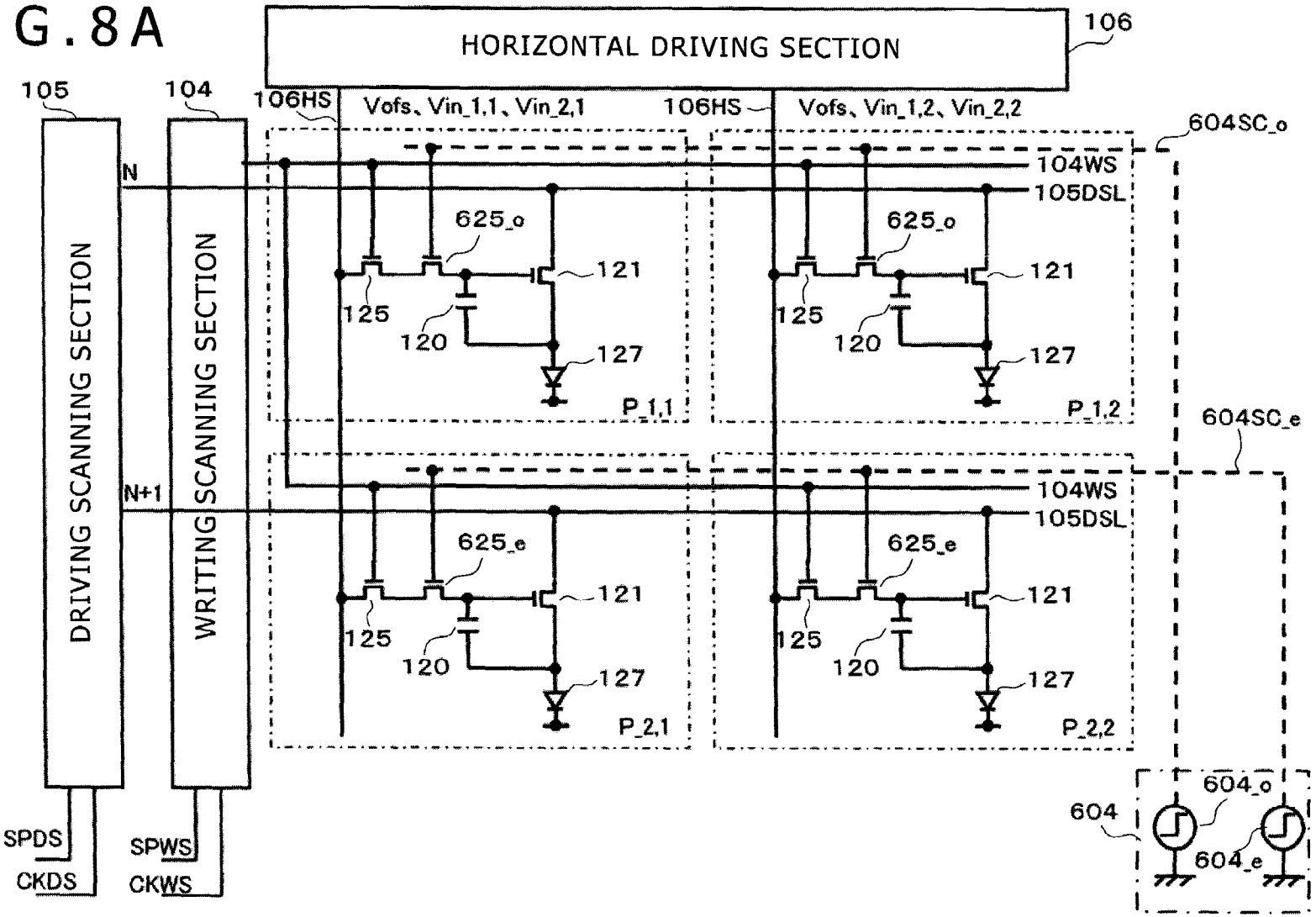
FIG. 8A is a diagram showing a fourth comparative example for the pixel circuits according to the present embodiment forming the organic EL display device shown in FIG. 1.
Figure 8B:
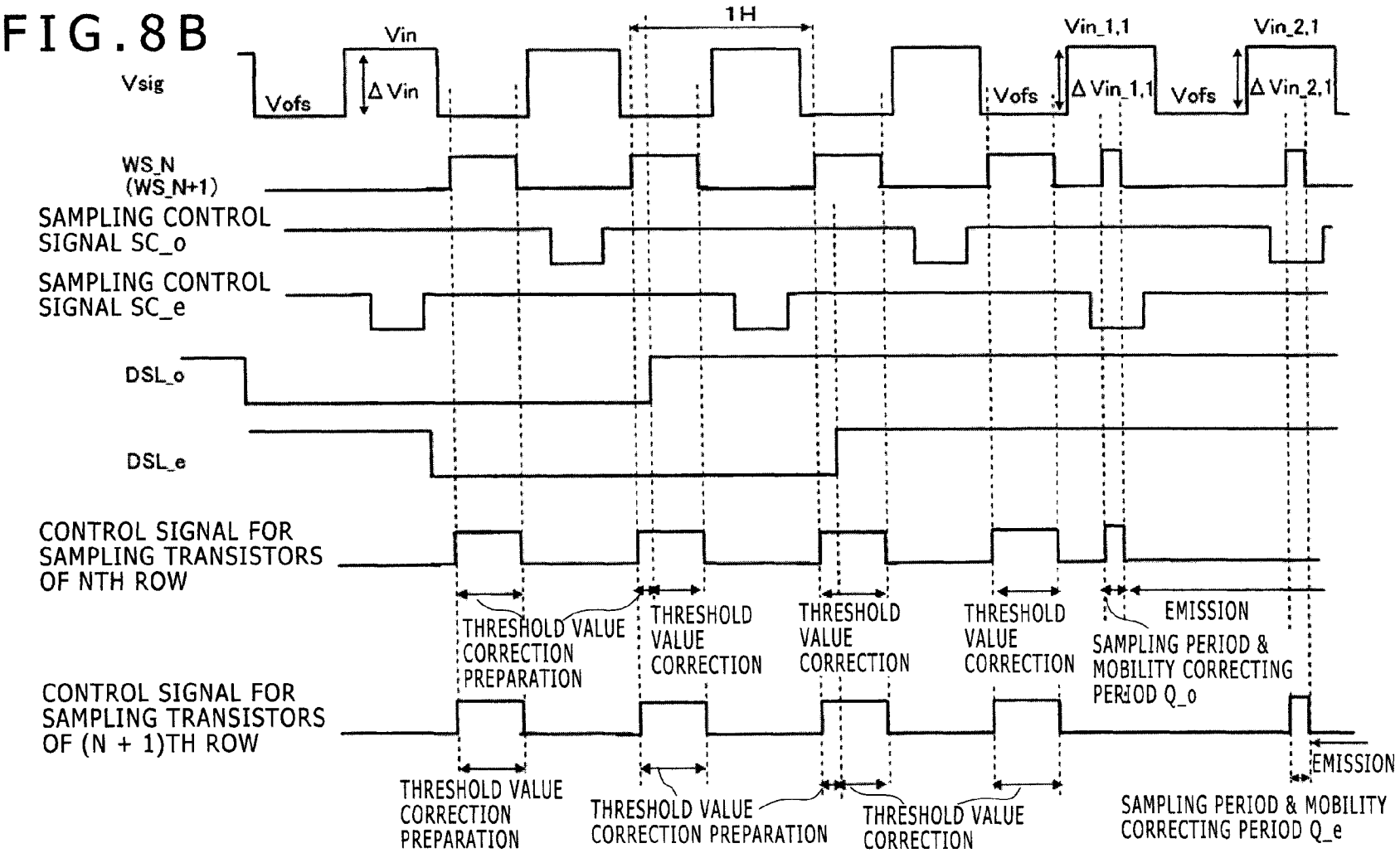
FIG. 8B is a timing chart of assistance in explaining driving timing according to the fourth comparative example of pixel circuits according to the fourth comparative example.

FIG. 8A is a diagram showing a fourth comparative example for the pixel circuits P according to the present embodiment forming the organic EL display device 1 shown in FIG. 1. FIG. 8B is a timing chart of assistance in explaining driving timing according to the fourth comparative example of pixel circuits P according to the fourth comparative example. FIG. 8B represents a case of line-sequential driving. FIG. 8B is a timing chart of assistance in explaining driving timing according to a fifth comparative example. FIG. 8B represents a case of line-sequential driving. Incidentally, together with four pixels (P_1,1 in a first row and a first column, P_1,2 in the first row and a second column, P_2,1 in a second row and the first column, and P_2,2 in the second row and the second column), FIG. 8A also shows the vertical driving unit 103 and the horizontal driving section 106 disposed on the periphery of the pixel circuits P on the substrate 101 of the display panel section 100. The fourth comparative example and the fifth comparative example are a mode in which cost is lowered by reducing the number of scanning lines.

Directing attention to the horizontal driving section 106 side when cost is to be lowered by reducing the number of scanning lines, sharing a video signal line 106HS between a plurality of pixels is considered. At this time, adopting a mechanism for reducing cost by sharing a signal line between a plurality of pixels in a liquid crystal display device is considered. For example, adopting a mechanism described in Patent Document 2 is considered.

However, although the mechanism described in Patent Document 2 is a system in which a signal line is shared by adjacent pixels and a video signal is rewritten by inputting two video signals to one pixel, and is thus effective means for a system in which signal writing while current is allowed to flow is not performed, the mechanism may not be simply adopted into the third comparative example in which mobility correction is made by performing signal writing while current is allowed to flow when driving a current-driven type electrooptic element. This is because when the video signal Vsig is input to the gate of a driving transistor 121 twice or more, mobility correction is made for the first video signal Vsig, and mobility correcting operation may not be performed normally for the video signal Vsig input to the gate of the driving transistor 121 for the second time and thereafter. It can thus be said that with the pixel circuit P according to the third comparative example, it is difficult to share the video signal line 106HS and there is a problem in terms of cost reduction.

On the other hand, directing attention to the vertical driving unit 103 side, sharing one of a writing scanning line 104WS and a power supply line 105DSL between a plurality of pixels is considered. When consideration is given to sharing a writing scanning line 104WS between a plurality of pixels, for example, adopting a configuration according to the fourth comparative example as shown in FIG. 8A is considered. The configuration according to the fourth comparative example represents a method of selecting signal sampling by a common line by row system. Specifically, the configuration according to the fourth comparative example is shown as an example in which a writing driving pulse WS supplied to the writing scanning line 104WS is shared between two lines. First, the sampling transistor is changed to a two-stage cascaded configuration of a first sampling transistor 125 and a second sampling transistor 625. In short, the sampling transistor is changed to a double-gate structure.

The video signal Vsig (offset potential Vofs or signal potential Vofs+ΔVin) from the video signal line 106HS is supplied to the gate of the driving transistor 121 when the two cascaded sampling transistors 125 and 625 are both turned on. Therefore the sampling transistors 125 and 625 perform an AND (logical product) function. It thus suffices to make a setting such that all sampling transistors 125 and 625 in all rows within a group are turned on for a threshold voltage correction preparatory pulse and a threshold voltage correcting pulse as a synthesis of the two sampling transistors 125 and 625 and such that the sampling transistors 625 are turned on according to each vertical scanning row for a signal writing pulse and a mobility correcting pulse.

For example, two lines (two rows) of first sampling transistors 125 are commonly controlled by a writing driving pulse WS from the writing scanning section 104. As for the second sampling transistors 625, as an example, the second sampling transistors 625 are divided into two systems of an odd-numbered row and an even-numbered row adjacent to each other, and sampling control lines 604SC_o and 604SC_e for the two lines are made common between columns and are driven individually.

Thus, as shown in FIG. 8A, in order to individually drive the sampling control lines 604SC_o and 604SC_e for the odd-numbered line and the even-numbered line, a control circuit 604 having a driving circuit 604_*o* for controlling the sampling control line 604SC_o by a sampling control signal SC_o and a driving circuit 604_*e* for controlling the sampling control line 604SC_e by a sampling control signal SC_e are provided separately from the writing scanning section 104 and the driving scanning section 105.

As in the timing chart according to the fourth comparative example shown in FIG. 8B, for the sampling transistors 625_*o* and 625_*e* in the second stage in the odd-numbered column, a sampling period & mobility correcting period Q is assigned to different horizontal scanning periods for the odd-numbered column and the even-numbered column. Thus, also considering a sampling period & mobility correcting period K for another row, the sampling control signal SC_o of the odd-numbered column is set inactive-L during the sampling period & mobility correcting period Q_e, and the sampling control signal SC_e of the even-numbered column is set inactive-L during the sampling period & mobility correcting period Q_o.

The first sampling transistors 125 of the two lines are commonly driven. The second sampling transistors 625 of the odd-numbered column are commonly driven, and the second sampling transistors 625 of the even-numbered column are also commonly driven. Thus, when threshold value correcting operation is performed a plurality of times, threshold value correcting operations of the odd-numbered line and threshold value correcting operations of the even-numbered line have a difference of one threshold value correcting operation. In the present example, the threshold value correcting operations of the even-numbered column are reduced by one. As a result, a time from an end of threshold value correction to signal sampling differs by one H or more between the odd-numbered line and the even-numbered line.

However, in the system as in the fourth comparative example, as factors causing problems of degradation in image quality such as nonuniformity, stripes and the like, there are a difference of one H or more in the time from an end of threshold value correction to signal sampling between the odd-numbered line and the even-numbered line (which difference will be referred to as a first factor) and a difference in the number of times of threshold value correction (which difference will be referred to as a second factor).

The degradation in image quality due to the first factor is caused because each line has a time difference in writing timing and the time difference is one H or more, not because there is a time of one H or more from an end of threshold value correction to signal sampling in each line. It is therefore considered that the first factor can be greatly remedied by shortening the time difference as in FIG. 8C.

The second factor is a difference in the number of times of threshold value correction, and thereby causes degradation in image quality. However, threshold value correction basically has a saturation tendency with respect to time. When the number of times of threshold value correction is increased to a certain degree (that is, when correction time is lengthened), an increase or a decrease of one time does not affect image quality. That is, it can be said that when the number of times of threshold value correction is small, a difference of one time is perceived as poor image quality, but as the number of times of threshold value correction is increased, the degree of effect of the difference of one time on image quality is decreased.

Figure 8C:
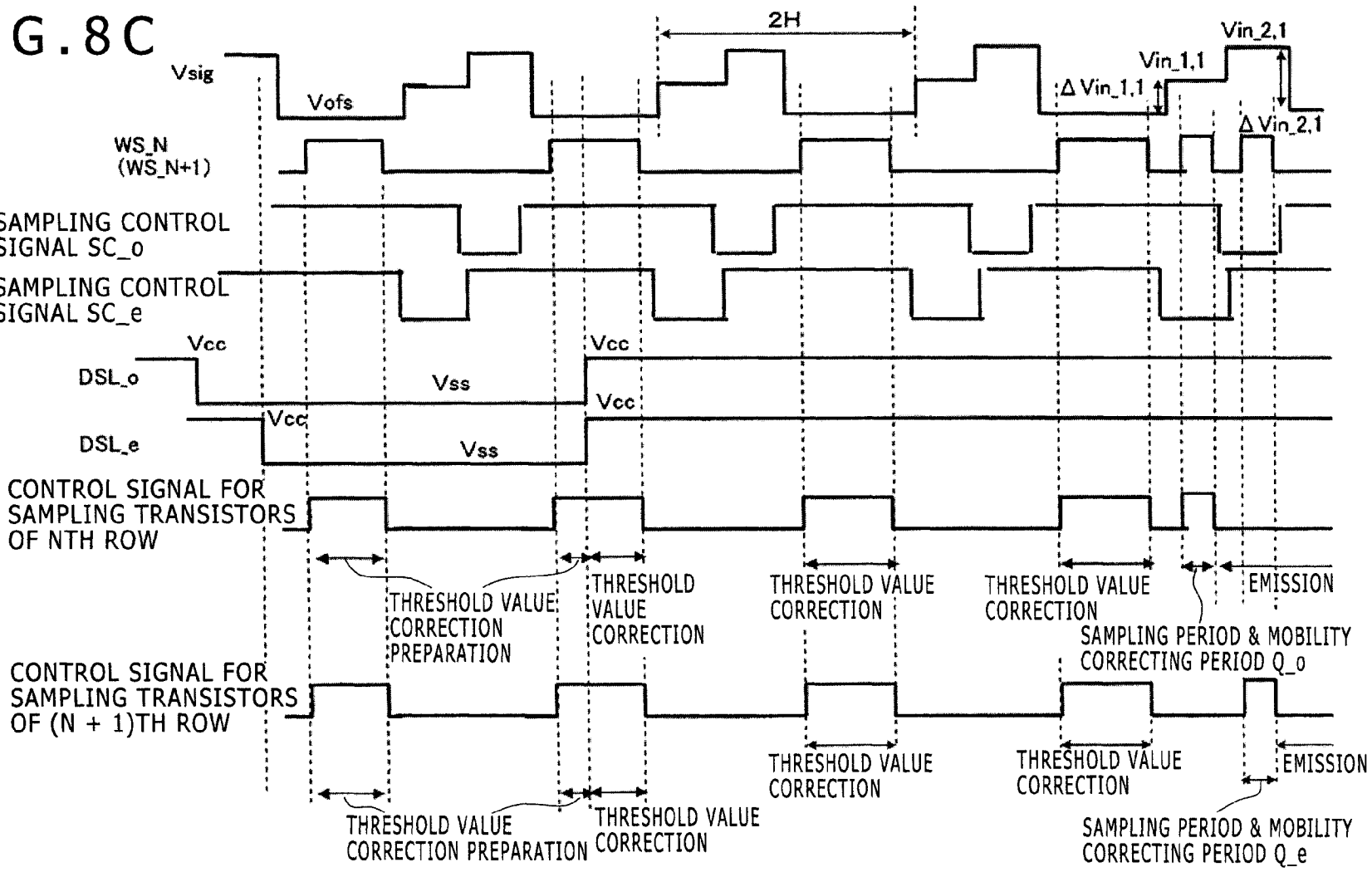
FIG. 8C is a timing chart of assistance in explaining driving timing according to a fifth comparative example.

As a method for solving the problem of degradation in image quality, from the mode of the first factor, as described above, as in the timing chart of the fifth comparative example shown in FIG. 8C, for example, a method is considered which performs driving using a common line as in the fourth comparative example while adopting a system in which a plurality of horizontal periods (2H period in the present example) are combined with each other, threshold value correction is commonly made (simultaneously in two lines) in the combined part, and thereafter signal writing is performed in order (in order of the odd-numbered column→the even-numbered column, for example) after a sampling period & mobility correcting period K begins.

However, in the fifth comparative example, to perform signal writing for the two lines combined with each other, it is necessary to change the video signal Vsig (signal potential Vin=Vofs+ΔVin to be exact) to a video signal Vsig_o for the odd-numbered row and a video signal Vsig_e for the even-numbered row. For this, the signal potential Vin (=Vofs+ΔVin) is changed to a signal potential Vin_o=Vofs+ΔVin_o for the odd-numbered row and a signal potential Vin_e=Vofs+ΔVin_e for the even-numbered row, this means that the horizontal driving section 106 needs to have a storage section (for example a line memory), which presents a difficulty in cost reduction.

First Embodiment

Improving Method

Figure 9A:
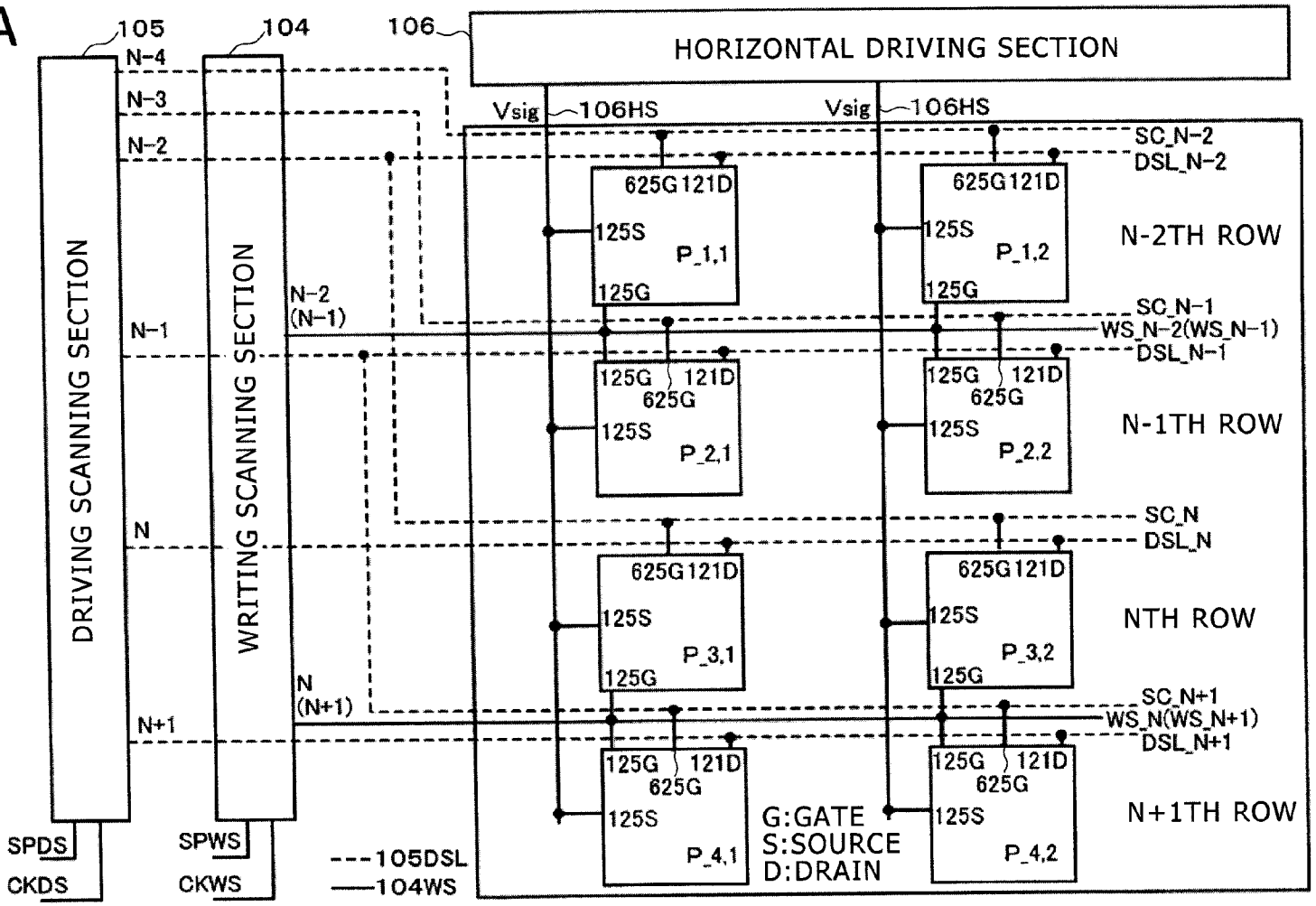
FIG. 9A is a diagram showing a general outline of connection relation of each scanning line and pixel circuits of an organic EL display device according to a first embodiment.
Figure 9B:
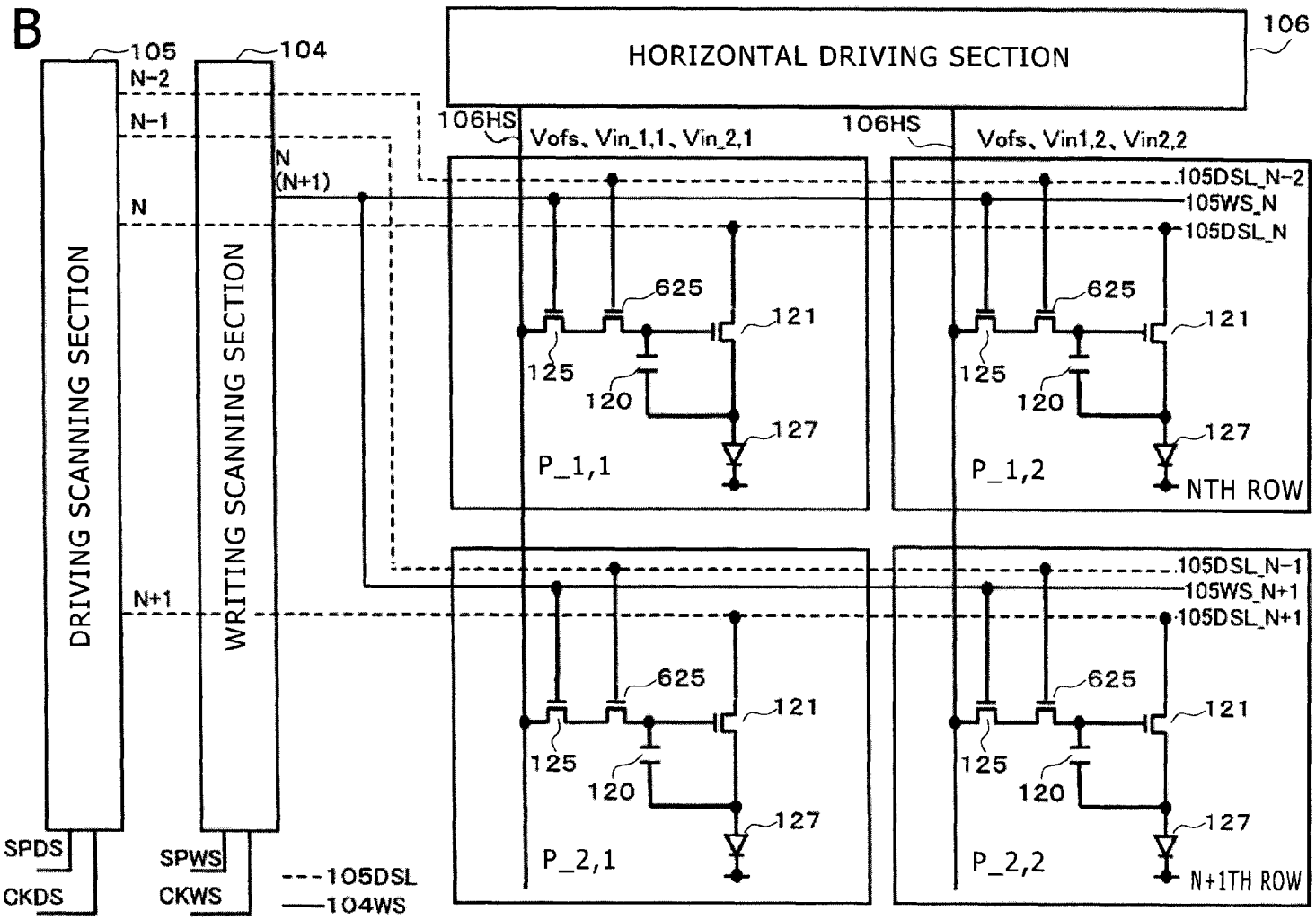
FIG. 9B is a diagram showing details of connection relation of pixel circuits and scanning lines according to the first embodiment.
Figure 9C:
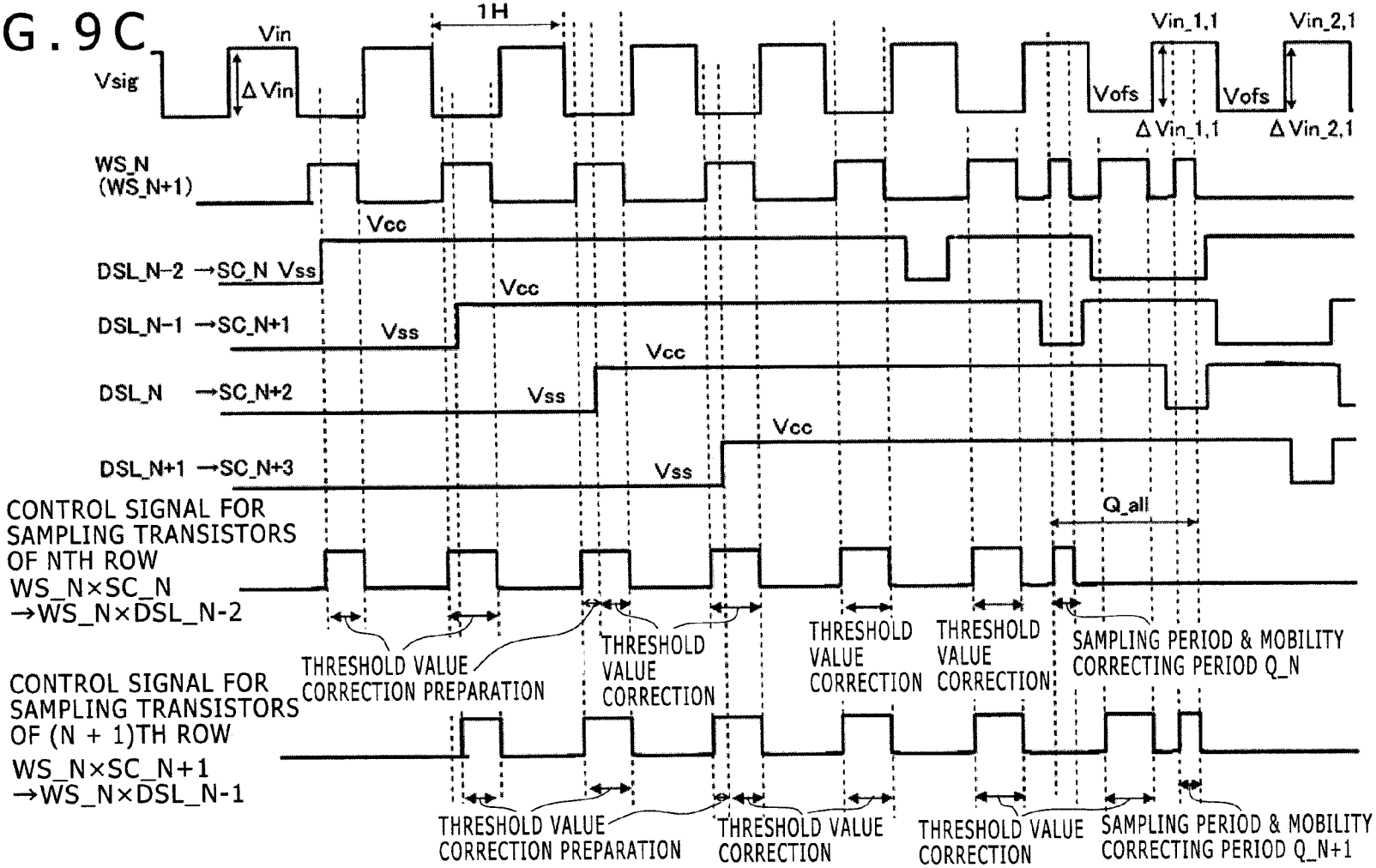
FIG. 9C is a timing chart of assistance in explaining driving timing according to the first embodiment.

FIGS. 9A to 9C are diagrams of assistance in explaining a first embodiment of an organic EL display device in which a writing scanning line 104WS and a power supply line 105DSL on a vertical driving unit 103 side are shared by a plurality of pixels while the problems of the fourth comparative example and the fifth comparative example shown in FIGS. 8A to 8C are solved. FIG. 9A is a diagram showing an outline of connection relation of each scanning line (a writing scanning line 104WS, a power supply line 105DSL, and a video signal line 106HS) between pixel circuits P of eight pixels (four rows and two columns) of the organic EL display device 1 according to the first embodiment and each scanning section (a writing scanning section 104, a driving scanning section 105, and a horizontal driving section 106). FIG. 9B is a diagram showing details of connection relation to pixel circuits P of four pixels (two rows and two columns) in FIG. 9A. FIG. 9C is a timing chart of assistance in explaining driving timing according to the first embodiment. FIG. 9C represents a case of line-sequential driving. In the following description, a row number may be identified by a row number reference element "_." The same is true for other embodiments to be described later.

In the present embodiment, including the other embodiments to be described later, in sharing a scanning line of a vertical scanning system between a plurality of pixels, the writing scanning line 104WS is shared by two (two rows of) pixel circuits P or more as in the fourth comparative example and the fifth comparative example. Specifically, the control input terminal (gate) of one sampling transistor (first sampling transistor 125) in a plurality of rows (a plurality of rows adjacent to each other in a typical example) is connected to a common writing scanning line 104WS, and is controlled by a common writing driving pulse WS.

Further, the present embodiment is defined in that the control input terminal (gate) of another sampling transistor (second sampling transistor 625) is connected to a vertical scanning line of the same kind or a different kind of another row (excluding a sharing part) so that for example a writing driving pulse WS of the other row or a power driving pulse DSL of the other row is used as a sampling control signal SC. Because the control input terminal of the other sampling transistor is connected to a vertical scanning line of the same kind or a different kind of another row, the writing scanning section 104 or the driving scanning section 105 can be used to control the sampling transistor 625. Thus, unlike the fifth comparative example, the present embodiment has an advantage of eliminating the need to provide a scanning section configured to control the other sampling transistor separately from the writing scanning section 104 and the driving scanning section 105.

An ordinary writing driving pulse WS is used to commonly control first sampling transistors 125 of a plurality of rows. On the other hand, second sampling transistors 625 are controlled to be turned on so as to coincide with the on state of the sampling transistors 125 in most parts of a plurality of display process periods (threshold voltage correcting periods in the present example) within the sharing group, using a writing driving pulse WS of another row or a power driving pulse DSL of another row.

In a period (total display process period: referred to as a total sampling period & mobility correcting period Q_all in the present example) from a start of a display process period (a signal writing period and a mobility correcting period in the present example) of one of the sharing rows to completion of display processes (signal writing and mobility correction in the present example) of all the sharing rows, control is performed such that a display process (signal writing and mobility correction in the present example) is performed in order by turning on one of the sampling transistors 625 in order so as to coincide with the on state of the sampling transistors 125.

When one of the sampling transistors 625 is turned on for a display process (signal writing and mobility correction in the present example) in the total sampling period & mobility correcting period Q_all, the sampling transistor 125 of the other row sharing the writing driving pulse WS and the writing scanning line 104WS is also on. Therefore, in order to prohibit display process operation (signal writing and mobility correction in the present example) of the other row, the writing driving pulse WS of the other row and the power driving pulse DSL of the other row are set such that the sampling transistor 625 of the other row is off.

In addition, the writing driving pulse WS of another row or the power driving pulse DSL of another row which pulse is also used to control sampling transistors 625 is made to have as similar a transition state as possible in each row. That is, the state of basic on/off operation of the transistors based on the writing driving pulse WS or the power driving pulse DSL in the other row is made as uniform as possible. This is to prevent an operation imbalance in some rows due to the use of the writing driving pulse WS or the power driving pulse DSL as a sampling control signal SC for controlling the sampling transistors 625. Thereby, an ordinary mechanism of creating a reference pulse and sequentially shifting the reference pulse in each H by a shift register can be applied to the scanning pulses for controlling the vertical scanning lines of the respective rows.

In particular, as a difference from other embodiments to be described later, the present embodiment is defined in that the control input terminal (gate) of the other sampling transistor is connected to the power supply line 105DSL of another row, and is thus controlled by using the power driving pulse DSL of the other row. That is, the other sampling transistor is controlled by using the power driving pulse DSL of the other row excluding the sharing part, thereby reducing the number of scanning lines (writing scanning lines 104WS) drawn out from the writing scanning section 104.

In order to facilitate understanding, as in the fourth comparative example and the fifth comparative example, each figure represents an example of sharing a writing driving pulse WS supplied to a writing scanning line 104WS for two rows. Incidentally, to distinguish vertical scanning lines of two kinds (writing scanning lines 104WS and power supply lines 105DSL) from each other, the power supply lines 105DSL are represented by a dotted line in FIGS. 9A and 9B (the same is true for the other embodiments to be described later).

In order to share a writing driving pulse WS supplied to a writing scanning line 104WS between two pixels (pixel circuits P of two lines) adjacent to each other in a vertical direction, first, as in the fourth comparative example shown in FIG. 8A, the sampling transistor is changed to a two-stage cascaded configuration of a first sampling transistor 125 and a second sampling transistor 625, and the sampling transistor is changed to a double-gate structure.

Then, as shown in FIGS. 9A and 9B, for first sampling transistors 125, pixel circuits P of two lines (two rows) are connected to a same writing scanning line 104WS, thereby commonly controlling the two lines by a writing driving pulse WS from the writing scanning section 104. The second sampling transistor 625 has a gate connected to a power supply line 105DSL preceding by two rows, and is thereby controlled by a power driving pulse DSL preceding by two rows from the driving scanning section 105.

For example, the respective gates of sampling transistors 125 of an Nth row and an (N+1)th row are commonly connected to a writing scanning line 104WS_N as a control line for the sampling transistors 125. The gates of sampling transistors 625 of the Nth row are connected to a power supply line 105DSL_N−2 as a power control line for driving transistors 121 of an (N−2)th row preceding the Nth row by two rows. The gates of sampling transistors 625 of the (N+1)th row are connected to a power supply line 105DSL_N−1 as a power control line for driving transistors 121 of an (N−1)th row preceding the (N+1)th row by two rows.

As is understood from FIGS. 9A and 9B, because the gates of sampling transistors 625 are connected to a power supply line 105DSL preceding by two rows, it is necessary to cross a writing scanning line 104WS or a power supply line 105DSL. Incidentally, while power supply lines 105DSL for controlling sampling transistors 625 are lacking in an end part of vertical scanning (uppermost part in the present example) of the pixel array section 102, it suffices to provide corresponding dummy rows.

FIG. 9C is a timing chart of the first embodiment. Including the other embodiments to be described later, line-sequential driving is performed, the timing (phase relation in particular) of a power driving pulse DSL, a writing driving pulse WS, and a video signal Vsig is defined with two rows sharing the writing driving pulse WS and the writing scanning line 104WS set as one group, and the timing is shifted by two Hs when the group is changed. The following description will be made directing attention to the Nth row and the (N+1)th row.

First, because a sampling transistor 125 and a sampling transistor 625 perform an AND (logical product) function, a control signal synthesized by the sampling transistors 125 and 625 of the Nth row is a logical product of a writing driving pulse WS_N (also serving as WS_N+1) and a power driving pulse DSL_N−2, and a control signal synthesized by the sampling transistors 125 and 625 of the (N+1)th row is a logical product of the writing driving pulse WS_N (also serving as WS_N+1) and a power driving pulse DSL_N_1.

The sampling period & mobility correcting period Q of sampling transistors 625_N of the Nth row and the sampling period & mobility correcting period Q of sampling transistors 625_N+1 of the (N+1)th row are assigned to different horizontal scanning periods. Thus, first, after the total sampling period & mobility correcting period Q_all begins, in consideration of prohibiting threshold value correction in another row so as to make the number of times of threshold value correction in the Nth row and the number of times of threshold value correction in the (N+1)th row equal to each other, the power driving pulse DSL_N−2 is set to a second potential Vss to hold the sampling transistors 625_N of the Nth row in an off state during threshold value correction in the (N+1)th row.

In consideration of prohibiting sampling & mobility correction in another row, the power driving pulse DSL_N−1 of the (N−1)th row used also as a sampling control signal SC_N+1 for controlling the sampling transistors 625_N+1 of the (N+1)th row is set to the second potential Vss in a sampling period & mobility correcting period Q_N, and is returned to a first potential Vcc after completion of signal writing in the Nth row. The power driving pulse DSL_N−2 of the (N−2)th row used also as a sampling control signal SC_N for controlling the sampling transistors 625_N of the Nth row is set to the second potential Vss in a sampling period & mobility correcting period Q_N+1, and is returned to the first potential Vcc after completion of signal writing in the (N+1) th row. The sampling of a signal potential Vin is determined by setting the power driving pulse DSL preceding by two rows to the second potential Vss.

Incidentally, in FIG. 9C, the power driving pulse DSL_N−2 is set to the second potential Vss after completion of signal writing in the Nth row and before a start of threshold value correction in the (N+1)th row, and the sampling period & mobility correcting period Q_N+1 begins with the power driving pulse DSL_N−2 remaining as it is. However, this is not essential. It suffices for the power driving pulse DSL_N−2 to be at the second potential Vss in at least a threshold voltage correcting period P_N+1 and the sampling period & mobility correcting period Q_N+1.

In the following, consideration will be given to the emission period of each row (first embodiment). When the power driving pulse DSL_N−2 of the (N−2)th row is set to the second potential Vss in the threshold voltage correcting period P_N+1 and the sampling period & mobility correcting period Q_N+1, and when no measure is taken, an emission time after off timing of the sampling transistors 125 after a sampling period & mobility correcting period Q_N−2 differs by a time during which the power driving pulse DSL_N−2 is set at the second potential Vss. Therefore a luminance difference between the (N−2)th row and the (N−1)th row is visually perceived.

Accordingly, to make the emission periods of organic EL elements 127 in the respective rows uniform, and to make the turning off of the sampling transistors 125 and the changing of the power supply lines 105DSL as power lines between the first potential Vcc and the second potential Vss (power off) after the total sampling period & mobility correcting period Q_all have similar transition states in the (N−2)th row and the (N−1)th row, the power driving pulse DSL_N−1 of the (N−1) th row is set to the second potential Vss in a state of being shifted to the rear by one H with respect to the (N−2)th row.

Incidentally, the power driving pulse DSL_N−2 of the (N−2)th row is set to the second potential Vss in a state of being shifted to the front by one H with respect to the (N−1)th row so as to conform to the setting of the power driving pulse DSL_N−1 to the second potential Vss in the sampling period & mobility correcting period Q_N. This makes the power driving pulses DSL_N−2 and DSL_N−1 of the (N−2)th row and the (N−1)th row have similar transition states in a state of being shifted from each other by one H. The on/off state of the power driving pulse DSL of each row becomes uniform in a state of being shifted by one H.

The emission period of the organic EL element 127 is basically determined by the timing of setting the writing driving pulse WS inactive after the sampling period & mobility correcting period Q (off timing of the sampling transistor 125) and the changing of the power supply line 105DSL as a power line to the second potential Vss (power off). In the present example, the power driving pulses DSL_N and DSL_N+1 are once changed to the second potential Vss before the power supply line 105DSL is changed to the second potential Vss to begin a threshold voltage correcting period after the writing driving pulse WS after the sampling period & mobility correcting period Q is set inactive. Thus, a point in time when the sampling transistor 125 is turned off after the sampling period & mobility correcting period Q of each row is emission start timing, and timing in which the power driving pulse DSL is thereafter changed to the second potential Vss for initialization before threshold value correcting operation begins is emission end timing. A total emission period is obtained by excluding the period during which the power driving pulse DSL is at the second potential Vss from a period from the emission start timing to the emission end timing.

Because two sampling transistors 125 and 625 perform an AND function, the power driving pulse DSL is changed to the second potential Vss to prevent erroneous operation of the other stage. As is understood from relation of the power driving pulse DSL in the timing charts of FIG. 7 and FIG. 9C, the timing of changing the power driving pulse DSL to the second potential Vss for initialization before threshold value correcting operation begins is shifted by one H in each row. Thus, the start timing and the end timing of the emission period of the Nth row and the start timing and the end timing of the emission period of the (N+1)th row are respectively shifted from each other by one H, and the emission periods of the Nth row and the (N+1)th row become equal to each other.

Thus, the mechanism according to the first embodiment determines the timing of sampling a signal potential and making mobility correction by setting the power driving pulse DSL of another group (preceding the Nth row and the (N+1)th row by two rows in the present example) to the second potential Vss (that is, by turning off power to the driving transistor 121). There is thus a period during which the power driving pulse DSL of the own row is also set at the second potential Vss after the sampling period & mobility correcting period. However, even when the power supply line 105DSL of the own row is set at the second potential Vss (that is, even when power is turned off) after completion of signal writing, the storage capacitor 120 is connected between the gate and the source of the driving transistor 121 and performs a bootstrap function, and therefore the gate-to-source voltage Vgs is constant. Thus, when the power supply line 105DSL returns to the first potential Vcc again (that is, when the power is turned on), the organic EL element 127 can normally emit light again, and the light emission luminance is unchanged.

In addition, the first sampling transistors 125 of the two rows are commonly driven, and the second sampling transistors 625 are driven on a row-by-row basis by the power driving pulses DSL_N−2 and DSL_N−1. Therefore, when threshold value correcting operation is performed a plurality of times while the sampling period & mobility correcting periods Q of the two rows sharing the writing driving pulse WS are assigned to different horizontal scanning periods, the threshold value correcting operation is performed a same number of times in each row, unlike the fourth comparative example. Hence, problems of degradation in image quality such as nonuniformity, stripes and the like as in the fourth comparative example do not occur.

In addition, the gates of the second sampling transistors 625 are connected to the power supply line 105DSL preceding by two rows, and are thus controlled by the power driving pulse DSL preceding by two rows. Therefore, unlike the fifth comparative example, it is not necessary to provide a scanning section configured to control the second sampling transistors 625 separately from the writing scanning section 104 and the driving scanning section 105, so that cost reduction can be surely achieved.

The number of writing scanning lines 104WS as control lines for the sampling transistors 125 can be reduced (halved in the present example) without the number of control signals output from the vertical driving unit 103 (a scanner or a driver) being increased, and without additional control circuits or control lines being provided on the outside, so that cost reduction can be surely achieved.

Incidentally, in the previous example, the gates of second sampling transistors 625 are connected to a power supply line 105DSL preceding by two rows. However, this is a mere example. The gates of second sampling transistors 625 may be connected to the power supply line 105DSL of any row as long as the power supply line 105DSL is the power supply line 105DSL of another row excluding the sharing part. However, an inconvenience occurs in that as the distance of the power supply line 105DSL from the sharing part is increased, wiring length is lengthened, and intersections with writing scanning lines 104WS are increased. For example, a timing shift due to an increase in wiring resistance, an increase of cross shorts due to the intersections, and the like may occur. There is also a drawback of an increase in the number of dummy rows provided in the end part of vertical scanning of the pixel array section 102. It is thus desirable to connect the gates of second sampling transistors 625 to a power supply line 105DSL in the vicinity of the sharing part.

In addition, in the previous example, the writing driving pulse WS is shared between two rows. However, this is a mere example. It suffices for the writing driving pulse WS to be shared to be for two rows, and the writing driving pulse WS to be shared does not necessarily need to be for two adjacent rows.

Further, in the previous example, to facilitate understanding, the writing driving pulse WS is shared between two adjacent rows. However, this is a mere example. The number of sharing objects is arbitrary (assumed to be k). The sampling transistors may have a double-gate structure, and the writing driving pulse WS may be shared between k rows. In this case, it suffices to connect second sampling transistors 625 to a power supply line 105DSL of each different row of another group excluding the sharing rows, and use the power driving pulse DSL of each different row as a sampling control signal SC. However, as in the case of sharing by two rows, as the distance of the power supply line 105DSL from the sharing part is increased, inconveniences occur in that wiring length is lengthened, intersections with writing scanning lines 104WS are increased, and dummy rows are increased, for example.

Second Embodiment

Improving Method

Figure 10A:
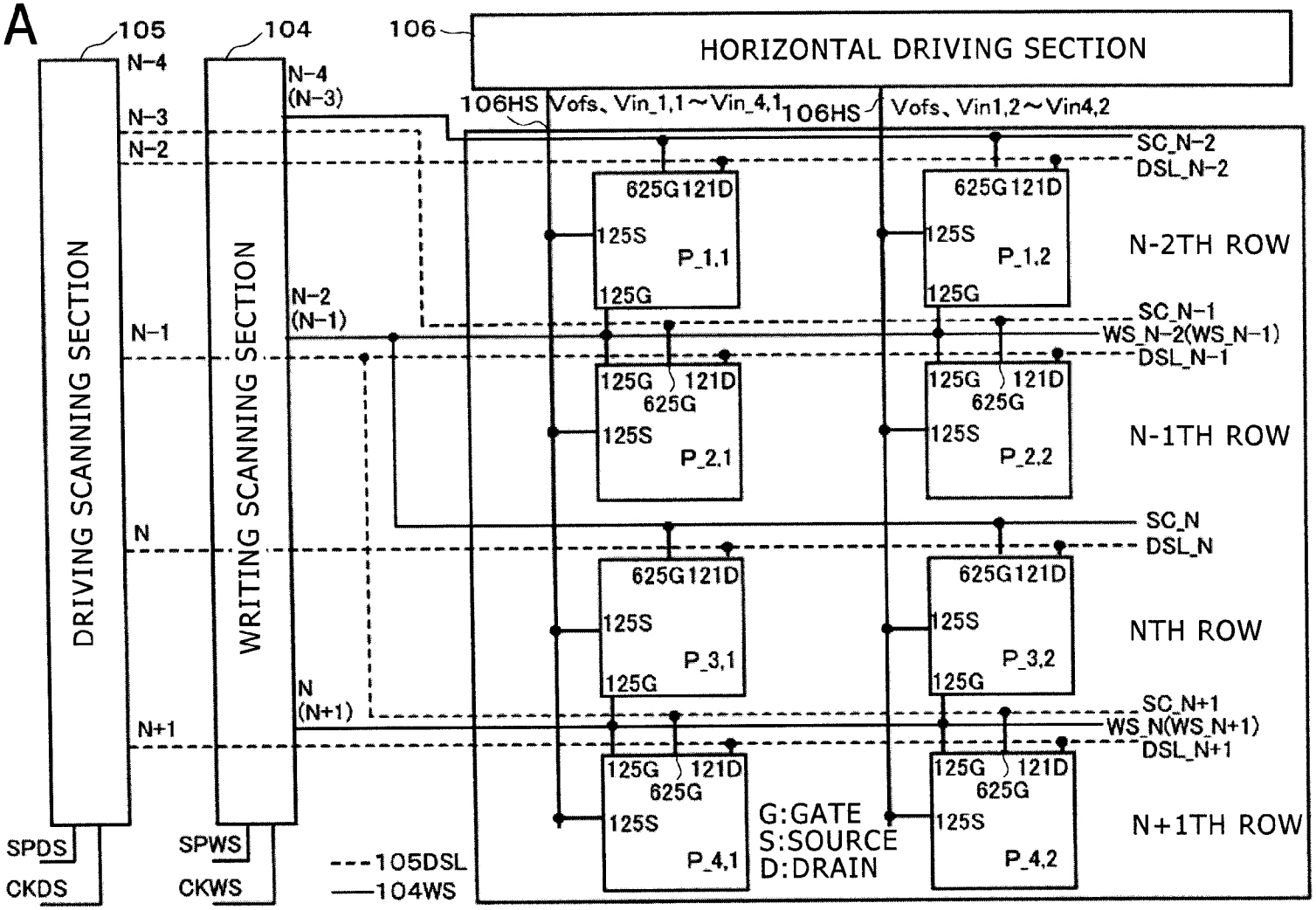
FIG. 10A is a diagram showing a general outline of connection relation of each scanning line and pixel circuits of an organic EL display device according to a second embodiment.
Figure 10B:
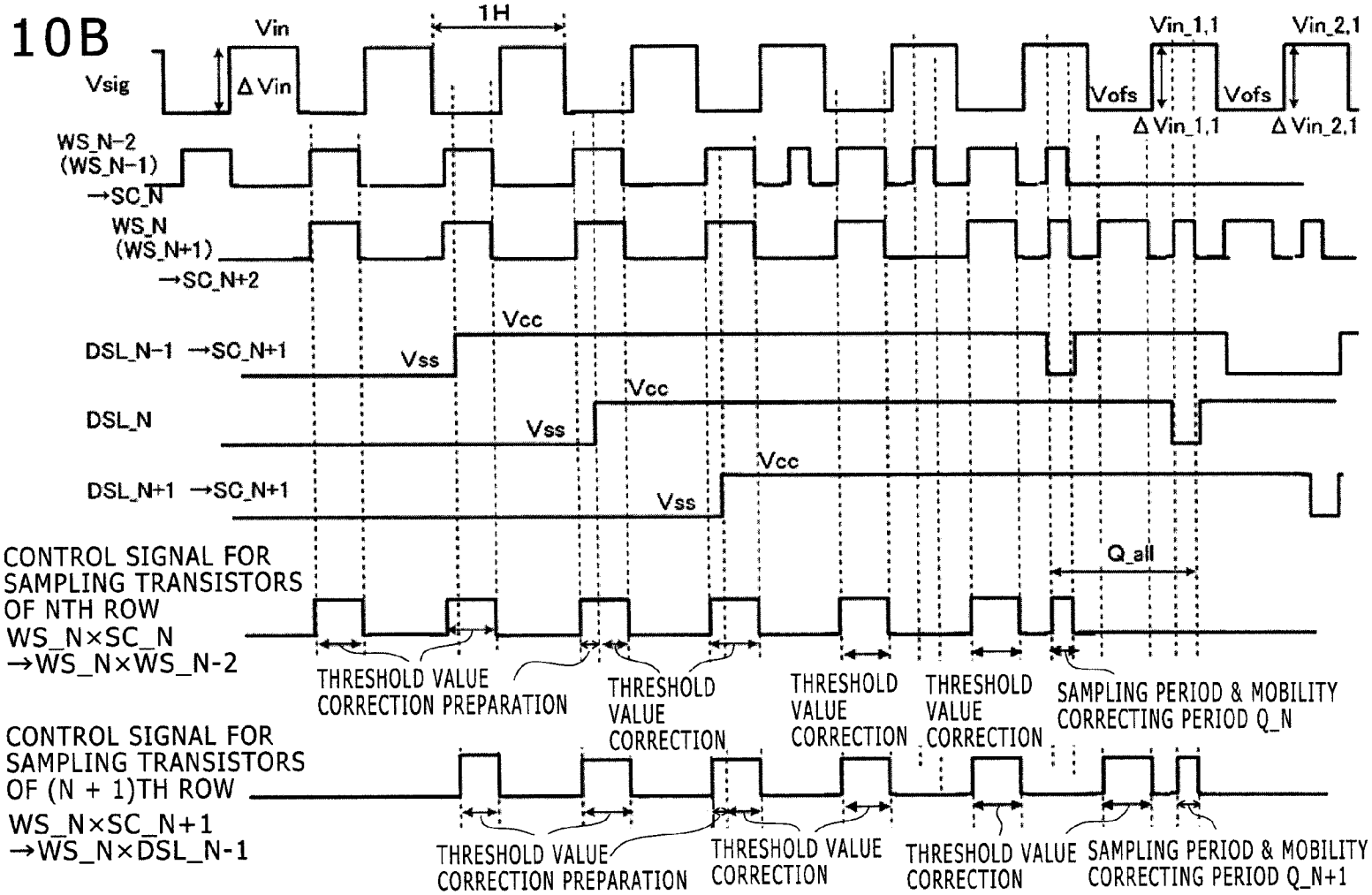
FIG. 10B is a timing chart of assistance in explaining driving timing according to the second embodiment.

FIGS. 10A and 10B are diagrams of assistance in explaining a second embodiment of an organic EL display device in which a writing scanning line 104WS and a power supply line 105DSL on a vertical driving unit 103 side are shared by a plurality of pixels while the problems of the fourth comparative example and the fifth comparative example shown in FIGS. 8A and 8B are solved. FIG. 10A is a diagram showing an outline of connection relation of each scanning line (a writing scanning line 104WS, a power supply line 105DSL, and a video signal line 106HS) between pixel circuits P of eight pixels (four rows and two columns) of the organic EL display device 1 according to the second embodiment and each scanning section (a writing scanning section 104, a driving scanning section 105, and a horizontal driving section 106). FIG. 10B is a timing chart of assistance in explaining driving timing according to the second embodiment. FIG. 10B represents a case of line-sequential driving. In order to facilitate understanding, as in the first embodiment, each figure shows an example of sharing a writing driving pulse WS supplied to pixel circuits P of two rows adjacent to each other and the writing scanning line 104WS.

The second embodiment is defined in that the control input terminals (gates) of second sampling transistors 625 in one of the sharing rows are connected to the writing scanning line 104WS of another group other than the sharing part, and are thus controlled by using the writing driving pulse WS of the other group as a sampling control signal SC, while the control input terminals (gates) of second sampling transistors 625 in the other of the sharing rows are connected to the power supply line 105DSL of another row of the other group other than the sharing part, and are thus controlled by using the power driving pulse DSL of the other row as a sampling control signal SC. That is, by controlling the second sampling transistors 625 using the writing driving pulse WS of the other group and the power driving pulse DSL of the other row (which pulses are supplied to different rows in the sharing part), the number of scanning lines (writing scanning lines 104WS) drawn out from the writing scanning section 104 is reduced, and the writing driving pulse WS is shared by a plurality of pixels.

In order to share a writing driving pulse WS supplied to a writing scanning line 104WS between two pixels (pixel circuits P of two lines) adjacent to each other in a vertical direction, first, as in the first embodiment shown in FIGS. 9A to 9C, the sampling transistor is changed to a two-stage cascaded configuration of a first sampling transistor 125 and a second sampling transistor 625. Then, as shown in FIG. 10A, for sampling transistors 125, pixel circuits P of two lines (two rows) are connected to the same writing scanning line 104WS, whereby the two lines are commonly controlled by the writing driving pulse WS from the writing scanning section 104. The gates of second sampling transistors 625 in one row of the sharing part are connected to the writing scanning line 104WS (preceding by two rows) of a sharing part preceding by one group, whereby the second sampling transistors 625 in one row of the sharing part are controlled by a writing driving pulse WS preceding by two rows from the writing scanning line 104WS, and the gates of second sampling transistors 625 in another row of the sharing part are connected to a power supply line 105DSL preceding by two rows, whereby the second sampling transistors 625 in the other row of the sharing part are controlled by a power driving pulse DSL preceding by two rows from the driving scanning section 105.

For example, the respective gates of sampling transistors 125 of an Nth row and an (N+1)th row are commonly connected to a writing scanning line 104WS as a control line for the sampling transistors 125. The gates of sampling transistors 625 of the Nth row are connected to a writing scanning line 104WS as a gate control line for sampling transistors 125 of an (N−2)th (or an (N−1)th) row of a sharing part preceding the sharing part of the sampling transistors 625 of the Nth row by one (preceding by one group). The gates of sampling transistors 625 of the (N+1)th row are connected to a power supply line 105DSL as a power control line for driving transistors 121 of the (N−1)th row preceding the (N+1)th row by two rows.

As is understood from FIG. 10A, because the gates of the second sampling transistors 625 are connected to the writing scanning line 104WS and the power supply line 105DSL preceding by two rows, it is necessary to cross the writing scanning line 104WS or the power supply line 105DSL. Incidentally, while writing scanning lines 104WS and power supply lines 105DSL for controlling sampling transistors 625 are lacking in an end part of vertical scanning (uppermost part in the present example) of the pixel array section 102, it suffices to provide corresponding dummy rows.

As in the timing chart of FIG. 10B of the second embodiment, the sampling period & mobility correcting period Q of the sampling transistors 625_N of the Nth row and the sampling period & mobility correcting period Q of the sampling transistors 625_N+1 of the (N+1)th row are assigned to different horizontal scanning periods. Thus, a writing driving pulse WS_N−2 (also serving as WS_N−1) preceding by one group for controlling the sampling transistors 625_N of the Nth row is set active-H during the sampling period & mobility correcting period Q_N.

In addition, in consideration of prohibition of sampling & mobility correction in the other row, a power driving pulse DSL_N−1 preceding by two rows which pulse is also used as a sampling control signal SC_N+1 for controlling the sampling transistors 625_N+1 of the (N+1)th row is set to a second potential Vss during the sampling period & mobility correcting period Q_N. Incidentally, during the sampling period & mobility correcting period Q_N+1 of the (N+1)th row, a writing driving pulse WS_N−2 preceding by one group which pulse is also used as a sampling control signal SC_N for controlling the sampling transistors 625_N of the Nth row is set inactive-L, and therefore the power driving pulse DSL_N of the Nth row may remain a first potential Vcc in principle. In the present example, however, the power driving pulse DSL_N is set at the second potential Vss for symmetry of operation. The sampling of a signal potential is in effect determined by setting the power driving pulse DSL preceding by one row to the second potential Vss. That is, this setting is made because the vertical driving unit 103 (a scanner or a driver) can be made simpler in configuration when all lines have similar change states with a shift of one H in each line. However, this is not essential.

In the following, consideration will be given to the emission period of each row (second embodiment). Also in the present example, a point in time when the sampling transistor 125 is turned off after the sampling period & mobility correcting period Q of each row is emission start timing, and timing in which the power driving pulse DSL is thereafter changed to the second potential Vss for initialization before threshold value correcting operation begins is emission end timing. A total emission period is obtained by excluding the period during which the power driving pulse DSL is at the second potential Vss from a period from the emission start timing to the emission end timing.

Thus, though different from the first embodiment in handling of control signals for controlling the second sampling transistors 625, the mechanism according to the second embodiment determines the timing of sampling a signal potential and making mobility correction by setting the power driving pulse DSL of another group (preceding the Nth row by one row) to the second potential Vss (that is, by turning off power to the driving transistor 121). There is thus a period during which the power driving pulse DSL of the own row is also set at the second potential Vss after the sampling period & mobility correcting period. However, as is understood from the description in the first embodiment, the storage capacitor 120 is connected between the gate and the source of the driving transistor 121 and performs a bootstrap function, and therefore the gate-to-source voltage Vgs is constant. Thus, when the power supply line 105DSL returns to the first potential Vcc again (that is, when the power is turned on), the organic EL element 127 can normally emit light again.

In addition, when threshold value correcting operation is performed a plurality of times while the sampling period & mobility correcting periods Q of the two rows sharing the writing driving pulse WS are assigned to different horizontal scanning periods, the threshold value correcting operation is performed a same number of times in each row, as in the first embodiment. Hence, problems of degradation in image quality such as nonuniformity, stripes and the like as in the fourth comparative example do not occur.

In addition, the gates of the second sampling transistors 625 in one row are connected to the writing scanning line 104WS preceding by one group, and are thus controlled by the writing driving pulse WS preceding by one group, while the gates of the second sampling transistors 625 in the other row are connected to the power supply line 105DSL preceding by two rows, and are thus controlled by the power driving pulse DSL preceding by two rows. Therefore, as in the first embodiment, the number of writing scanning lines 104WS as control lines for the sampling transistors 125 can be reduced (halved in the present example) without the number of control signals output from the vertical driving unit 103 (a scanner or a driver) being increased, and without additional control circuits or control lines being provided on the outside. Thus cost reduction can be surely achieved.

Third Embodiment

Improving Method

Figure 11A:
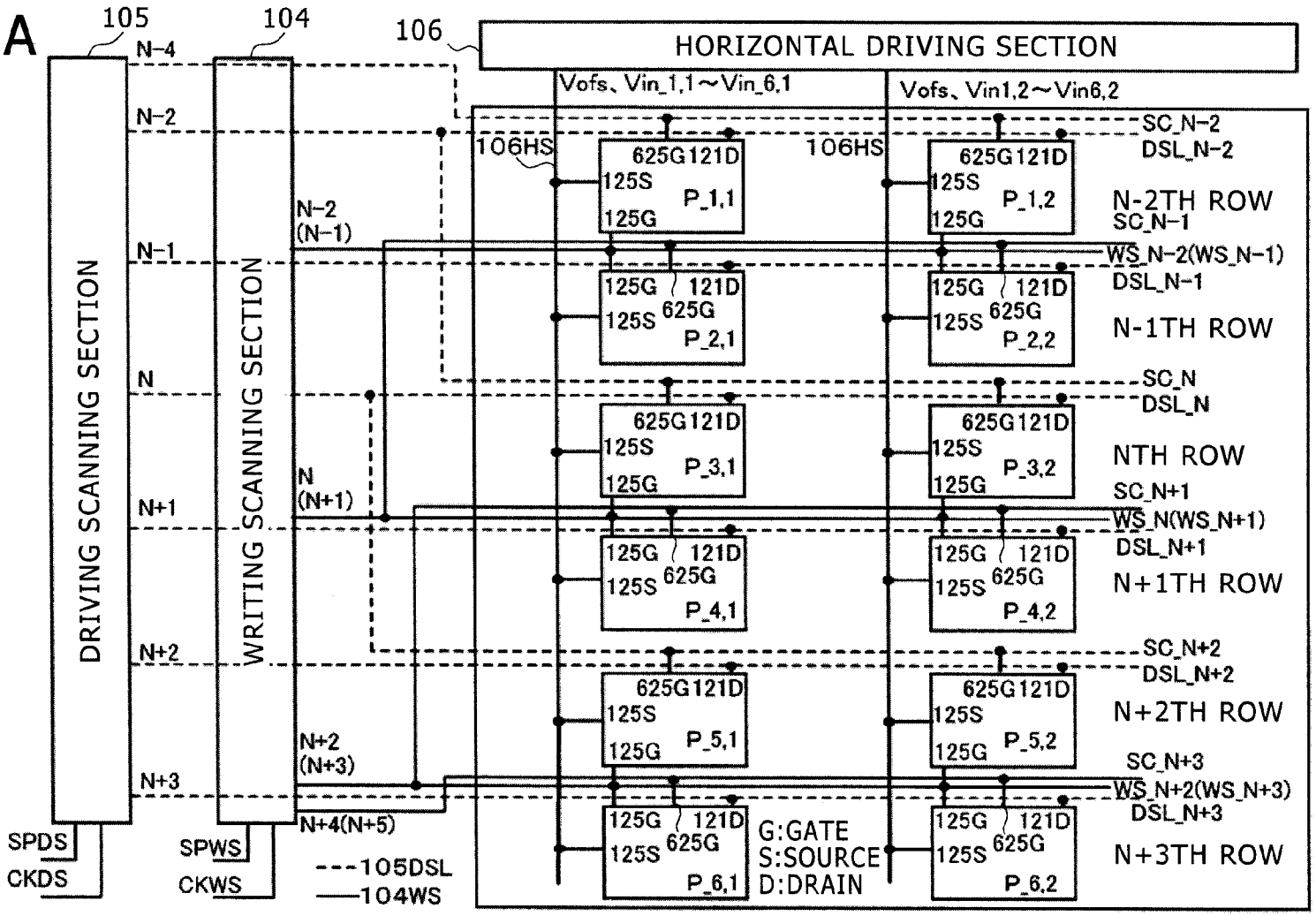
FIG. 11A is a diagram showing a general outline of connection relation of each scanning line and pixel circuits of an organic EL display device according to a third embodiment.
Figure 11B:
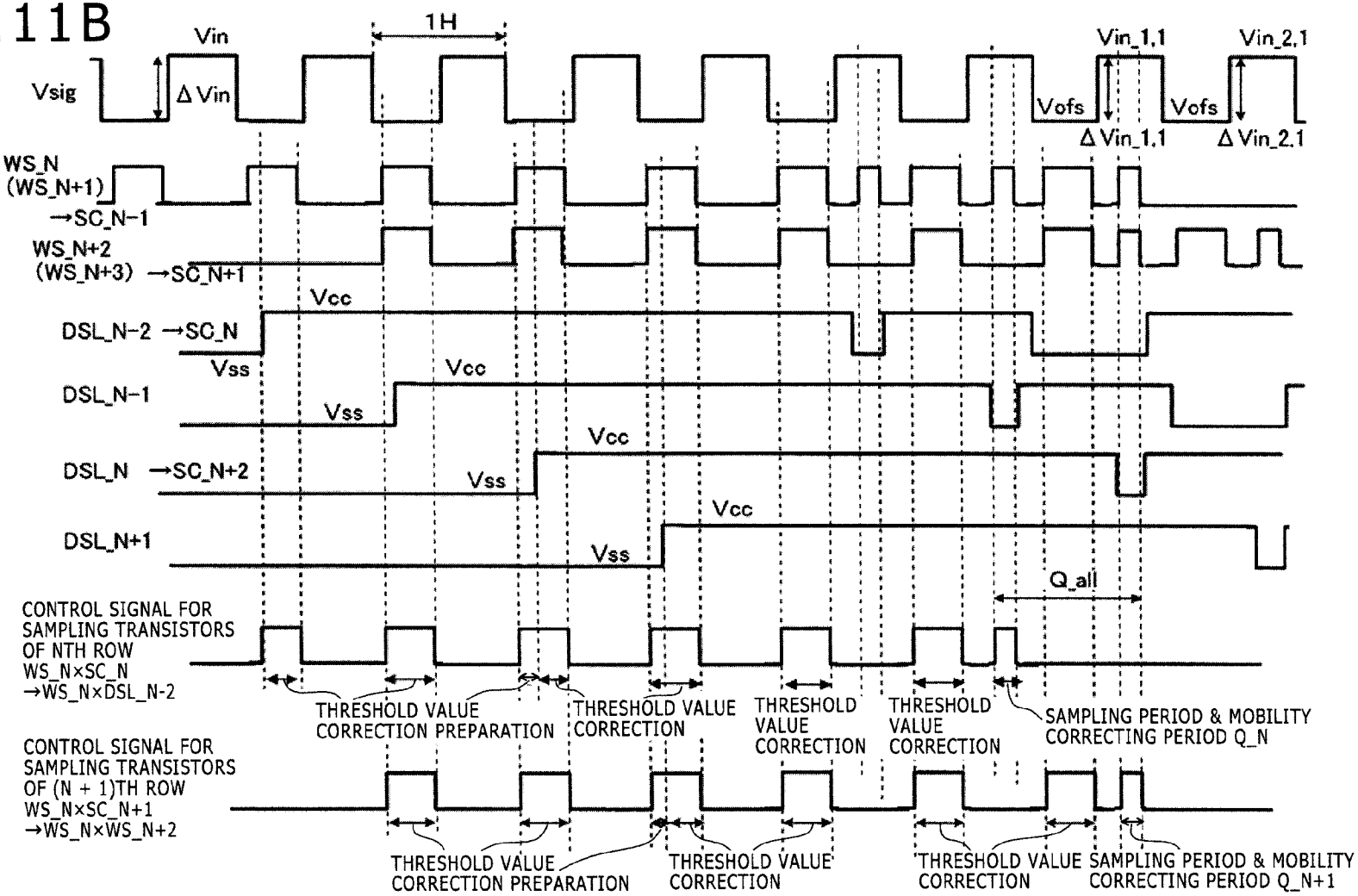
FIG. 11B is a timing chart of assistance in explaining driving timing according to the third embodiment.

FIGS. 11A and 11B are diagrams of assistance in explaining a third embodiment of an organic EL display device in which a writing scanning line 104WS and a power supply line 105DSL on a vertical driving unit 103 side are shared by a plurality of pixels while the problems of the fourth comparative example and the fifth comparative example shown in FIGS. 8A and 8B are solved. FIG. 11A is a diagram showing an outline of connection relation of each scanning line (a writing scanning line 104WS, a power supply line 105DSL, and a video signal line 106HS) between pixel circuits P of 12 pixels (6 rows and 2 columns) of the organic EL display device 1 according to the third embodiment and each scanning section (a writing scanning section 104, a driving scanning section 105, and a horizontal driving section 106). FIG. 11B is a timing chart of assistance in explaining driving timing according to the third embodiment. FIG. 11B represents a case of line-sequential driving. In order to facilitate understanding, as in the first and second embodiments, each figure shows an example of sharing a writing driving pulse WS supplied to pixel circuits P of two rows adjacent to each other and the writing scanning line 104WS.

The third embodiment is defined in that the control input terminals (gates) of second sampling transistors 625 in one of the sharing rows are connected to the power supply line 105DSL of another row, and are thus controlled by using the power driving pulse DSL of the other row, while the control input terminals (gates) of second sampling transistors 625 in the other of the sharing rows are connected to the writing scanning line 104WS of another group other than the sharing part, and are thus controlled by using the writing driving pulse WS of the other group. That is, by controlling the second sampling transistors 625 using the power driving pulse DSL of the other row excluding the sharing part and the writing driving pulse WS of the other group, the number of scanning lines (writing scanning lines 104WS) drawn out from the writing scanning section 104 is reduced. The third embodiment may be considered to be the same as the second embodiment in effect with only a difference in handling one and the other.

For example, the respective gates of sampling transistors 125 of an Nth row and an (N+1)th row are commonly connected to a writing scanning line 104WS as a control line for the sampling transistors 125. The gates of sampling transistors 625 of the Nth row are connected to a power supply line 105DSL as a power control line for driving transistors 121 of an (N−2)th row preceding the Nth row by two rows. The gates of sampling transistors 625 of the (N+1)th row are connected to a writing scanning line 104WS as a gate control line for sampling transistors 125 of an (N+2)th (or an (N+3)th) row of a sharing part succeeding the sharing part of the sampling transistors 625 of the (N+1)th row by one (succeeding by one group).

As is understood from FIG. 11A, because the gates of the second sampling transistors 625 are connected to the power supply line 105DSL preceding by two rows and the writing scanning line 104WS succeeding by one row, it is necessary to cross the writing scanning line 104WS or the power supply line 105DSL. Incidentally, while writing scanning lines 104WS and power supply lines 105DSL for controlling sampling transistors 625 are lacking in an end part of vertical scanning (an uppermost part for the power supply lines 105DSL and a lowermost part for the writing scanning lines 104WS in the present example) of the pixel array section 102, it suffices to provide corresponding dummy rows.

As in the timing chart of FIG. 11B of the third embodiment, the sampling period & mobility correcting period Q of the sampling transistors 625_N of the Nth row and the sampling period & mobility correcting period Q of the sampling transistors 625_N+1 of the (N+1)th row are assigned to different horizontal scanning periods. Thus, first, a writing driving pulse WS_N+2 (also serving as WS_N+3) succeeding by one group for controlling the sampling transistors 625_N+1 of the (N+1)th row is set active-H during the sampling period & mobility correcting period Q_N+1. In addition, in consideration of prohibiting threshold value correction in another row so as to make the number of times of threshold value correction in the Nth row and the number of times of threshold value correction in the (N+1)th row equal to each other, a power driving pulse DSL_N−2 is set to a second potential Vss to hold the sampling transistors 625_N of the Nth row in an off state during threshold value correction in the (N+1)th row.

In addition, in consideration of prohibiting sampling & mobility correction in another row, the power driving pulse DSL_N−2 preceding by two rows which pulse is used also as a sampling control signal SC_N for controlling the sampling transistors 625_N of the Nth row is set to the second potential Vss in a sampling period & mobility correcting period Q_N+1. Incidentally, in FIG. 11B, the power driving pulse DSL_N−2 is set to the second potential Vss after completion of signal writing in the Nth row and before a start of threshold value correction in the (N+1)th row. However, this is not essential. It suffices for the power driving pulse DSL_N−2 to be at the second potential Vss in at least a threshold value correcting period P_N+1 and the sampling period & mobility correcting period Q_N+1. In effect, as in the second embodiment, the sampling of a signal potential is determined by setting the power driving pulse DSL preceding by one row to the second potential Vss.

Incidentally, a power driving pulse DSL_N−1 is changed to the second potential Vss during the sampling period & mobility correcting period Q_N of the Nth row, and a power driving pulse DSL_N is changed to the second potential Vss during the sampling period & mobility correcting period Q_N+1 of the (N+1)th row. This is to make the change state of the scanning pulse of each line uniform in a state of being shifted by one H. That is, this setting is made because the vertical driving unit 103 (a scanner or a driver) can be made simpler in configuration when all lines have similar change states with a shift of one H in each line. However, this is not essential.

In the following, consideration will be given to the emission period of each row (third embodiment). In the third embodiment, the power driving pulse DSL_N−2 is used as sampling control signal SC_N for controlling the sampling transistors 625 of the Nth row as in the first embodiment, and thus a measure similar to that of the first embodiment is necessary. Specifically, when the power driving pulse DSL_N−2 of the (N−2)th row is set to the second potential Vss in the threshold voltage correcting period P_N+1 and the sampling period & mobility correcting period Q_N+1, and when no measure is taken, an emission time after off timing of the sampling transistors 125 after a sampling period & mobility correcting period Q_N−2 differs by a time during which the power driving pulse DSL_N−2 is set at the second potential Vss. Therefore a luminance difference between the (N−2)th row and the (N−1)th row is visually perceived.

Accordingly, to make the emission periods of organic EL elements 127 in the respective rows uniform, and to make the turning off of the sampling transistors 125 and the changing of the power supply lines 105DSL as power lines between the first potential Vcc and the second potential Vss (power off) after the sampling period & mobility correcting period Q have similar transition states in the (N−2)th row and the (N−1)th row, the power driving pulse DSL_N−1 of the (N−1)th row is set to the second potential Vss in a state of being shifted to the rear by one H with respect to the (N−2)th row. The rest is the same as in the first embodiment.

Thus, the mechanism of the third embodiment is opposite to that of the second embodiment in terms of handling of one and the other of the second sampling transistors 625. However, the basic idea of the third embodiment is similar to that of the second embodiment, and thus the third embodiment can provide similar effects to those of the second embodiment.

A comparison of the first embodiment with the second and third embodiments directing attention to the handling of the sampling control signals SC for controlling the second sampling transistors 625 of the double-gate structure indicates that the first embodiment is different from the second and third embodiments in that the first embodiment uses control signals of a same kind (the power driving pulses DSL of different rows of another group) as sampling control signals SC, whereas the second and third embodiments use control signals of different kinds (the writing driving pulse WS and the power driving pulse DSL of another group) as sampling control signals SC.

The first embodiment using the vertical scanning pulses of the same kind (power driving pulses DSL) is superior from a viewpoint of symmetry of operation, that is, the timing of the sampling control signals SC for controlling the second sampling transistors 625. This is because the writing scanning line 104WS and the power supply line 105DSL are different from each other in load, and there is a fear of the difference appearing in an image when the vertical scanning pulses of the different kinds are used to control the second sampling transistors 625 in sharing the writing driving pulse WS and the writing scanning line 104WS between a plurality of rows.

Incidentally, also in the second embodiment and the third embodiment, as described in the first embodiment, the number of writing driving pulses WS and writing scanning lines 104WS that are shared is not limited to two, and the setting of rows of the writing driving pulse WS and the power driving pulse DSL for controlling the gates of the second sampling transistors 625 is not limited to the foregoing example as long as the rows are different from each other in a different group from the group of the writing driving pulse WS and the writing scanning line 104WS that are shared. However, as in the case of sharing by two rows, as the distance of the rows of the writing driving pulse WS and the power driving pulse DSL from the sharing part is increased, inconveniences occur in that wiring length is lengthened, intersections with writing scanning lines 104WS are increased, and dummy rows are increased, for example.

In the case of the vertical scanning pulses of the different kinds, the control pulse (sampling control signal SC) and the power driving pulse DSL of near pixels can be used, and thus there is an advantage of easy routing of wiring. As for superiority or inferiority of the second embodiment and the third embodiment, the second embodiment uses pulses of nearer lines, and thus makes the routing of wiring simpler.

Fourth Embodiment

Improving Method

Figure 12A:
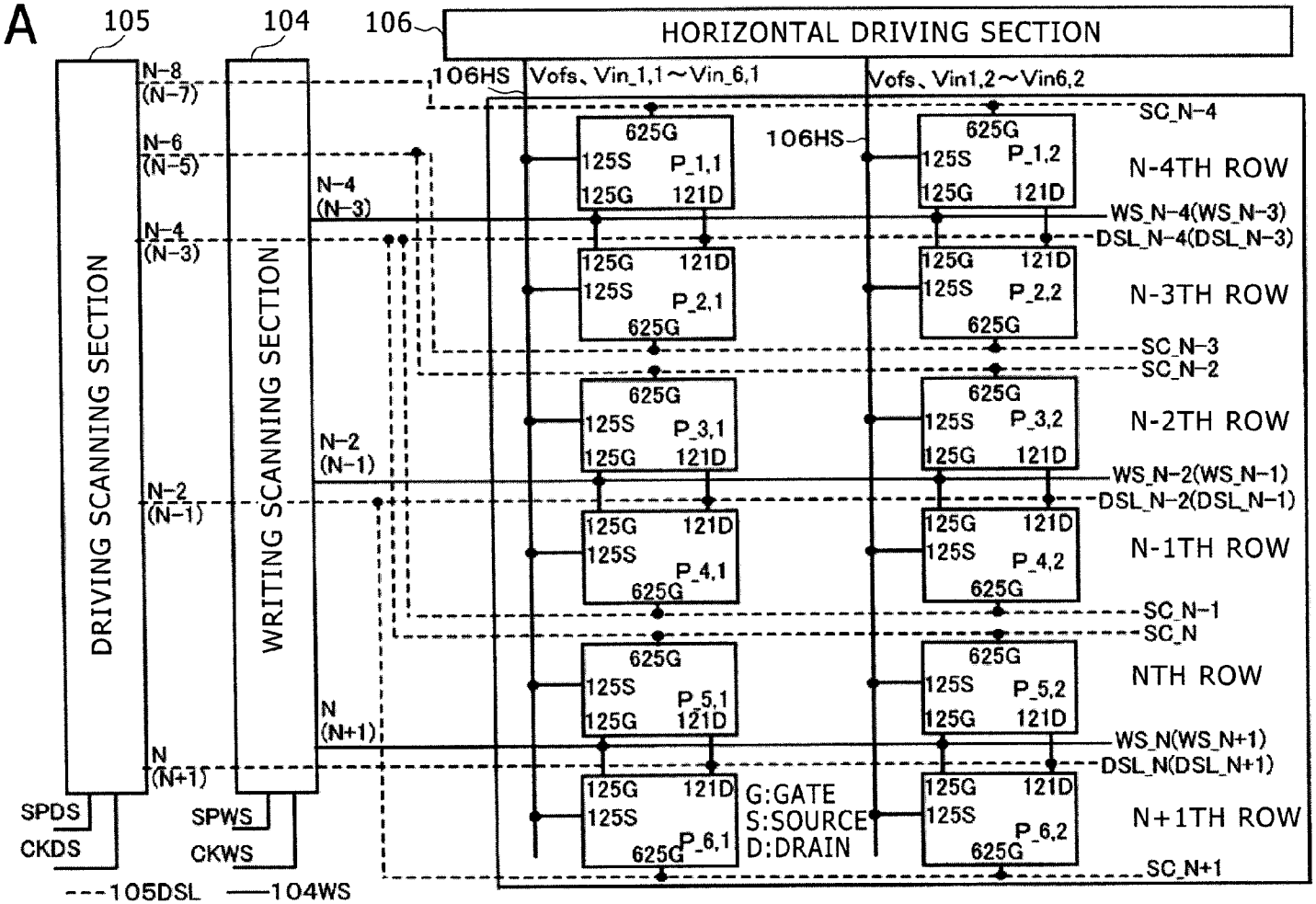
FIG. 12A is a diagram showing a general outline of connection relation of each scanning line and pixel circuits of an organic EL display device according to a fourth embodiment.
Figure 12B:
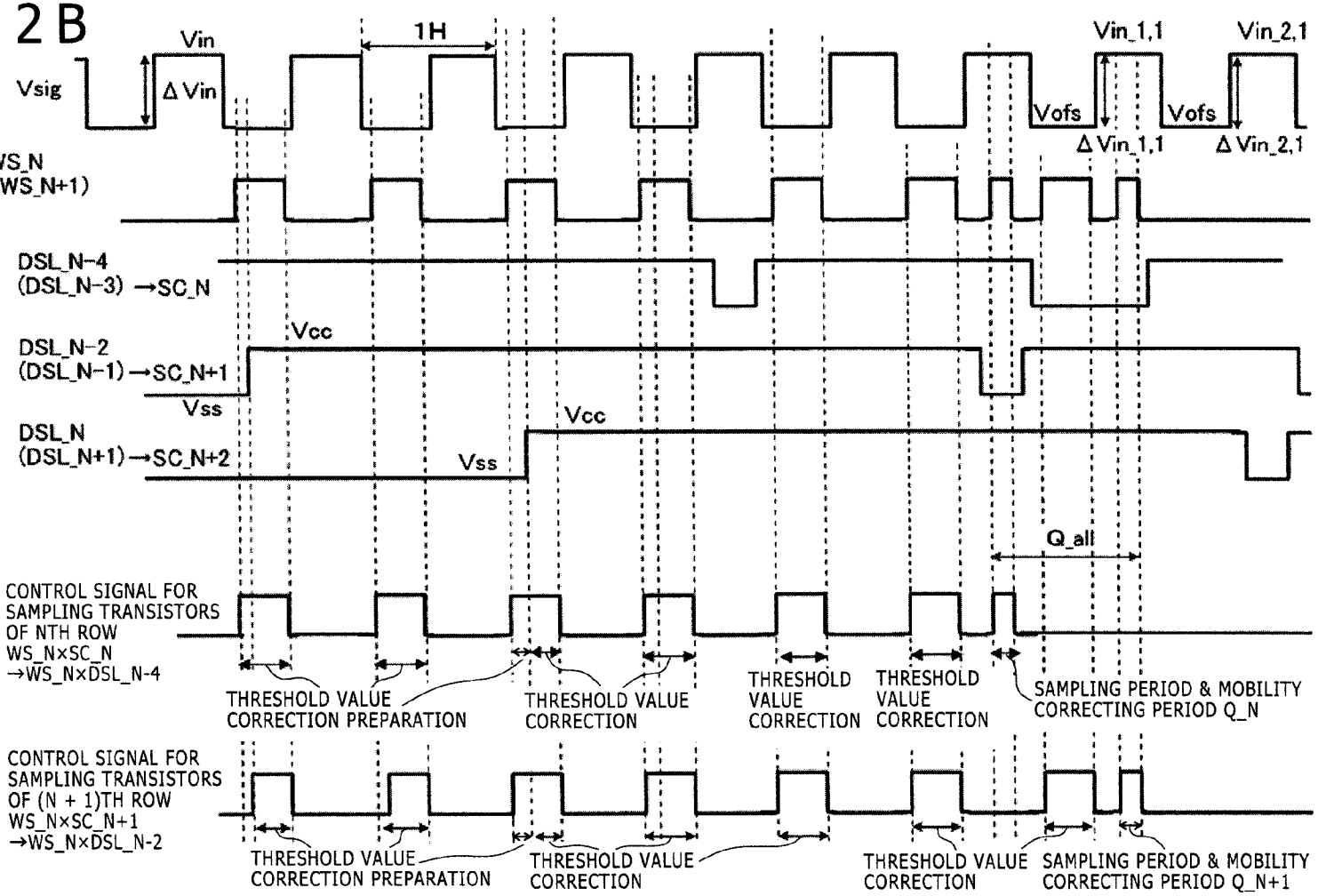
FIG. 12B is a timing chart (1) of assistance in explaining driving timing according to the fourth embodiment.
Figure 12C:
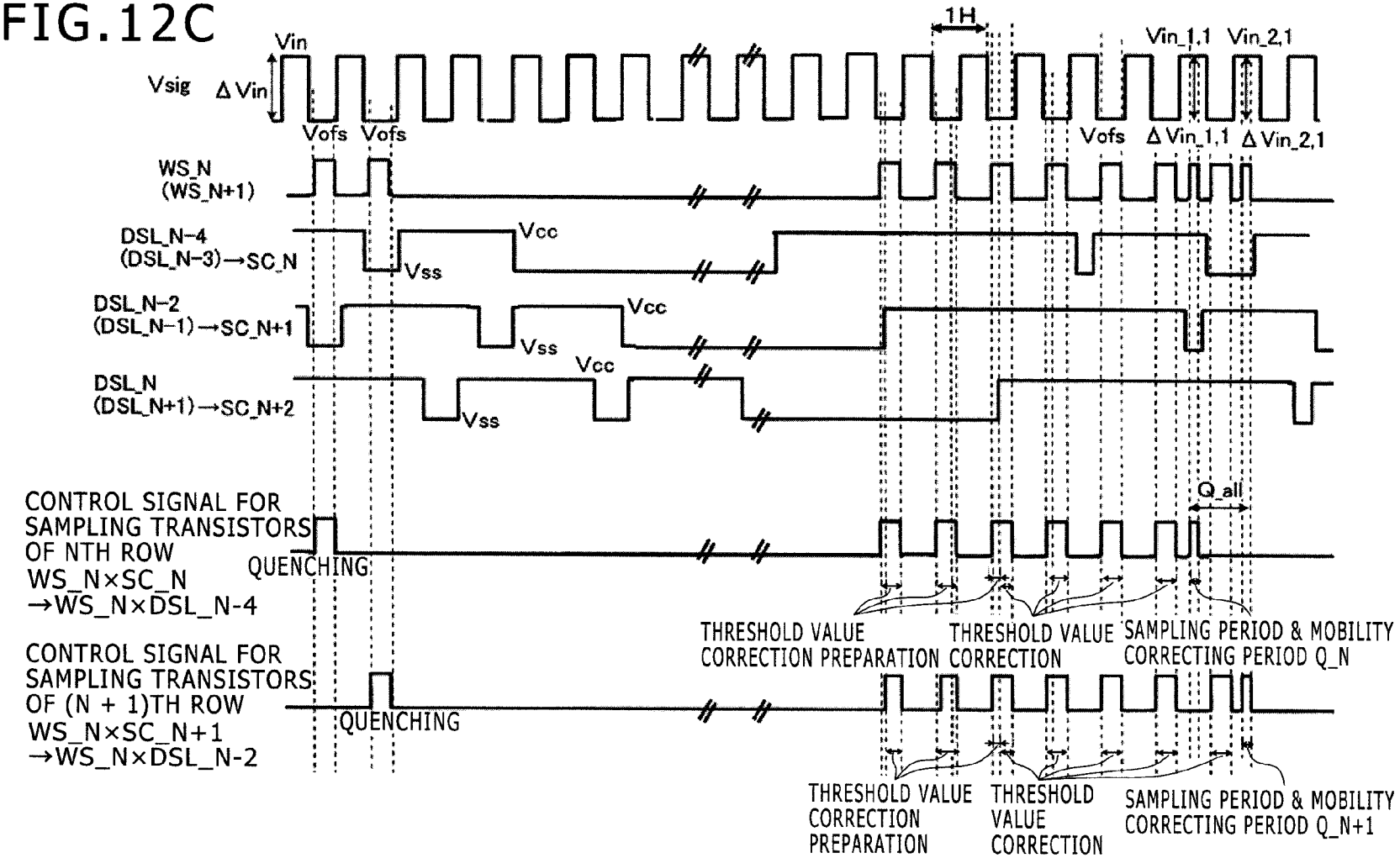
FIG. 12C is a timing chart (2) of assistance in explaining driving timing according to the fourth embodiment.

FIGS. 12A to 12C are diagrams of assistance in explaining a fourth embodiment of an organic EL display device in which a writing scanning line 104WS and a power supply line 105DSL on a vertical driving unit 103 side are shared by a plurality of pixels while the problems of the fourth comparative example and the fifth comparative example shown in FIGS. 8A to 8C are solved. FIG. 12A is a diagram showing an outline of connection relation of each scanning line (a writing scanning line 104WS, a power supply line 105DSL, and a video signal line 106HS) between pixel circuits P of 12 pixels (six rows and two columns) of the organic EL display device 1 according to the fourth embodiment and each scanning section (a writing scanning section 104, a driving scanning section 105, and a horizontal driving section 106). FIGS. 12B and 12C are timing charts of assistance in explaining driving timing according to the fourth embodiment. FIGS. 12B and 12C represent a case of line-sequential driving. In order to facilitate understanding, as in the first to third embodiments, each figure shows an example of sharing driving pulses (scanning pulses) of a vertical scanning system which pulses are supplied to pixel circuits P of two rows adjacent to each other and vertical scanning lines.

The fourth embodiment is defined in that the sampling transistor is formed into a double-gate structure of a sampling transistor 125 and a sampling transistor 625, a writing driving pulse WS for two rows is shared, and even a power driving pulse DSL for two rows is shared.

Any of the first to third embodiments described above can be adopted for control of second sampling transistors 625 of the double-gate structure. The gates of sampling transistors 625 are connected to a vertical scanning line of a same kind or a different kind (a writing scanning line 104WS or a power supply line 105DSL) of another row excluding a sharing part, and are thus controlled by using the writing driving pulse WS of the other row or the power driving pulse DSL of the other row. However, in the fourth embodiment, because a power driving pulse DSL is also shared by pixel circuits P of a plurality of rows, a change is made as appropriate so as to use the power driving pulse DSL of another group when using the power driving pulse DSL to control sampling transistors 625.

For example, to facilitate understanding, as shown in FIGS. 12A and 12B, each figure shows an example in which a writing driving pulse WS supplied to a writing scanning line 104WS for two rows is shared, and a power driving pulse DSL supplied to a power supply line 105DSL for the same two rows is shared. First, as in the first to third embodiments, to share a writing driving pulse WS supplied to a writing scanning line 104WS between two pixels (pixel circuits P of two lines) adjacent to each other in a vertical direction, the sampling transistor is formed into a two-stage cascaded configuration of a first sampling transistor 125 and a second sampling transistor 625, whereby the sampling transistor has a double-gate structure.

Then, as shown in FIG. 12A, for first sampling transistors 125, the pixel circuits P of the two lines (two rows) are connected to the same writing scanning line 104WS, whereby the two lines are commonly controlled by the writing driving pulse WS from the writing scanning section 104. The gates of second sampling transistors 625 in an Nth row and an (N+1)th row are connected to power supply lines 105DSL of different groups, and are thereby controlled by power driving pulses DSL of the different groups from the driving scanning section 105.

For example, the gates of the sampling transistors 625 of the Nth row are connected to a power supply line 105DSL_N−4 (also serving as 105DSL_N−3) as a power control line for driving transistors 121 of an (N−4)th row and an (N−3)th row preceding the Nth row by two groups. The gates of the sampling transistors 625 of the (N+1)th row are connected to a power supply line 105DSL_N−2 (also serving as 105DSL_N−1) as a power control line for driving transistors 121 of an (N−2)th row and an (N−1)th row preceding the (N+1)th row by one group.

As is understood from FIG. 12A, because the gates of the second sampling transistors 625 are connected to the power supply lines 105DSL preceding by two groups and preceding by one group, it is necessary to cross the writing scanning line 104WS or the power supply line 105DSL. Incidentally, while power supply lines 105DSL for controlling sampling transistors 625 are lacking in an end part of vertical scanning (an uppermost part in the present example) of the pixel array section 102, it suffices to provide corresponding dummy rows.

As in the timing chart of FIG. 12B of the fourth embodiment, the sampling period & mobility correcting period Q of the sampling transistors 625_N of the Nth row and the sampling period & mobility correcting period Q of the sampling transistors 625_N+1 of the (N+1)th row are assigned to different horizontal scanning periods. Thus, first, in consideration of prohibiting threshold value correction in another row so as to make the number of times of threshold value correction in the Nth row and the number of times of threshold value correction in the (N+1)th row equal to each other, a power driving pulse DSL_N−4 (also serving as DSL_N−3) preceding by two groups is set to a second potential Vss to hold the sampling transistors 625_N of the Nth row in an off state during threshold value correction in the (N+1)th row.

In addition, in consideration of prohibiting sampling & mobility correction in another row, a power driving pulse DSL_N−2 (also serving as DSL_N−1) preceding by one group which pulse is used also as a sampling control signal SC_N+1 for controlling the sampling transistors 625_N+1 of the (N+1)th row is set to the second potential Vss in a sampling period & mobility correcting period Q_N, and is returned to a first potential Vcc after completion of signal writing in the Nth row. Further, the power driving pulse DSL_N−4 (also serving as DSL_N−3) preceding by two groups which pulse is used also as a sampling control signal SC_N for controlling the sampling transistors 625_N of the Nth row is set to the second potential Vss in a sampling period & mobility correcting period Q_N+1, and is returned to the first potential Vcc after completion of signal writing in the (N+1)th row. The sampling of a signal potential is determined by setting the power driving pulse DSL of another group to the second potential Vss.

In the mechanism of the fourth embodiment, the gate of one of the second sampling transistors 625 is connected to the power supply line 105DSL preceding by two groups and is thus controlled by the power driving pulse DSL preceding by two groups, while the gate of the other of the second sampling transistors 625 is connected to the power supply line 105DSL preceding by one group and is thus controlled by the power driving pulse DSL preceding by one group. Thus, as in the first to third embodiments, the number of writing scanning lines 104WS as control lines for the sampling transistors 125 can be reduced (halved in the present example) without the number of control signals output from the vertical driving unit 103 (a scanner or a driver) being increased, and without additional control circuits or control lines being provided on the outside. Thus cost reduction can be surely achieved.

In addition, in the mechanism of the fourth embodiment, the power driving pulse DSL is also shared between two rows. Therefore, the writing scanning lines 104WS as control lines for the writing driving pulses WS and the power supply lines 105DSL as control lines for the power driving pulses DSL can be reduced (halved in the present example) without additional control lines being provided on the outside. Thus cost can be reduced more than in the first to third embodiments.

In the following, consideration will be given to the emission period of each row (fourth embodiment). The fourth embodiment is similar to the first embodiment in handling of the sampling control signal SC_N for controlling the sampling transistors 625_N of the Nth row, with only a difference of whether the pulse used as the sampling control signal SC_N precedes by two rows or precedes by two groups, and thus a measure similar to that of the first embodiment is necessary. Specifically, when the power driving pulse DSL_N−4 preceding by two groups is set to the second potential Vss in a threshold voltage correcting period P_N+1 and the sampling period & mobility correcting period Q_N+1, and when no measure is taken, an emission time after off timing of the sampling transistors 125 after a sampling period & mobility correcting period Q_N−2 differs by a time during which the power driving pulse DSL_N−4 is set at the second potential Vss. Therefore a luminance difference between the (N−4)th row and the (N−3)th row and the (N−2)th row and the (N−1)th row is visually perceived.

Accordingly, to make the emission periods of organic EL elements 127 in the respective rows uniform, and to make the turning off of the sampling transistors 125 and the changing of the power supply lines 105DSL as power lines between the first potential Vcc and the second potential Vss (power off) after the sampling period & mobility correcting period Q have similar transition states in the (N−4)th row and the (N−3)th row and the (N−2)th row and the (N−1)th row, the power driving pulse DSL_N−2 (also serving as DSL_N−1) of the (N−2)th row and the (N−1)th row is set to the second potential Vss in a state of being shifted to the rear by one H with respect to the (N−4)th row and the (N−3)th row. The rest is the same as in the first embodiment. However, this is insufficient.

First, the driving timing of the third comparative example to the third embodiment uses a method of quenching the organic EL element 127 by changing the power supply line 105DSL to the second potential Vss (that is, power-off). The emission period of the organic EL element 127 is therefore determined by the turning off of the sampling transistor 125 after the sampling period & mobility correcting period Q and the changing of the power supply line 105DSL as power line to the second potential Vss (power-off).

On the other hand, with the mechanism of the fourth embodiment, the changing of the power supply line 105DSL of the Nth row and the (N+1)th row to the second potential Vss (power-off) is in the same timing, and thus the timing of changing the power driving pulse DSL to the second potential Vss for initialization before threshold value correcting operation begins (that is, the timing of ending the emission period) is the same in the Nth row and the (N+1)th row. Thus, even when the same measure as in the first embodiment is taken, emission time differs by one H between the Nth row and the (N+1)th row due to a difference of one H in the timing of starting the emission period between the Nth row and the (N+1)th row, so that a luminance difference is visually perceived.

In order to solve this problem, when adopting the mechanism of the fourth embodiment, it is desirable to adopt a method of quenching the organic EL element 127 after turning on (effecting conduction of) both the first sampling transistor 125 and the second sampling transistor 625 of the double-gate structure when signal line potential (potential of the video signal line 106HS) becomes an offset potential Vofs as shown in FIG. 12C and thereby sampling the information of the offset potential Vofs in a storage capacitor 120, without ending the emission period (quenching the organic EL element 127) by changing the power supply line 105DSL to the second potential Vss (control by the power line). It is thereby possible to eliminate a difference in emission time between rows, and thus obtain uniform image quality without nonuniformity of luminance.

Incidentally, with the mechanism of the fourth embodiment, as is clear from FIG. 12B, threshold value correcting operation is not performed a same number of times unlike the first to third embodiments. In this regard, the fourth embodiment is the same as the fourth comparative example shown in FIGS. 8A and 8C. However, unlike the fourth comparative example, a time from completion of threshold value correction to signal sampling is the same in each line of the Nth row and the (N+1)th row, and is within one H. In addition, as for a degree of effect of a difference in the number of times of threshold value correction on image quality, while a difference of one in the number of times of threshold value correction is perceived as poor image quality when the number of times of threshold value correction is small, the effect of a difference of one in the number of times of threshold value correction is reduced as the number of times of threshold value correction is increased. Thus, even when the number of times of threshold value correction differs by one as in the present example, problems of degradation in image quality such as nonuniformity, stripes and the like are practically solved.

Incidentally, the first to fourth embodiments described above specifically show the mechanism of sharing a writing driving pulse WS (writing scanning line 104WS) between a plurality of rows in an example of application to the mechanism of making mobility correction by performing signal writing while passing current from the driving transistor 121 (that is, while sampling information corresponding to a signal potential Vin in the storage capacitor 120) when driving the organic EL element 127 as an example of a current-driven type electrooptic element. However, the application is possible to a pixel circuit that performs signal writing without passing current, that is, a system that makes mobility correction after completely finishing signal writing to the storage capacitor 120 without passing current through the driving transistor 121 (signal writing and mobility correction are performed in different timings) as well as a system that passes current through the driving transistor 121 and proceeds to mobility correction after nearly ending signal writing to the storage capacitor 120 without passing current through the driving transistor 121.

For example, the first to fourth embodiments are applicable to a 5TR configuration described in Patent Document 1. In this case, it suffices to apply the first to fourth embodiments by replacing the power supply line 105DSL and the power driving pulse DSL in the first to fourth embodiments with a scanning line DS connected to the gate of a transistor Tr4 and a control signal DS described in the above publication, and replacing the writing scanning line 104WS and the writing driving pulse WS with a scanning line WS connected to the gate of a transistor Tr1 and a control signal WS described in the above publication.

While the present invention has been described above using embodiments thereof, the technical scope of the present invention is not limited to a scope described in the foregoing embodiments. Various changes and improvements can be made to the foregoing embodiments without departing from the spirit of the invention, and forms obtained by adding such changes and improvements are also included in the technical scope of the present invention.

In addition, the foregoing embodiments do not limit inventions of claims, and not all combinations of features described in the embodiments are necessarily essential to solving means of the invention. The foregoing embodiments include inventions in various stages, and various inventions can be extracted by appropriately combining a plurality of disclosed constitutional requirements. Even when a few constitutional requirements are omitted from all the constitutional requirements disclosed in the embodiments, constitutions resulting from the omission of the few constitutional requirements can be extracted as inventions as long as an effect is obtained.

<Examples of Modification of Pixel Circuit>

For example, changes can be made from a mode of the pixel circuit P. For example a "duality principle" holds in circuit theory, and thus modifications can be made to the pixel circuit P from this viewpoint. In this case, though not shown in figures, while the pixel circuit P shown in each of the foregoing embodiments is formed using an n-channel type driving transistor 121, the pixel circuit P is formed using a p-channel type driving transistor 121. Changes following the duality principle are made accordingly, such for example as reversing the polarity of the signal amplitude ΔVin with respect to the offset potential Vofs of the video signal Vsig and relation of magnitude of the power supply voltage.

For example, in a pixel circuit P in a mode of modification following the "duality principle", a storage capacitor 120 is connected between the gate terminal and the source terminal of a p-type driving transistor (hereinafter referred to as a p-type driving transistor 121*p*), and the source terminal of the p-type driving transistor 121*p* is directly connected to the cathode terminal of an organic EL element 127. The anode terminal of the organic EL element 127 is set at an anode potential Vanode as a reference potential. The anode potential Vanode is connected to a reference power supply (high potential side) that supplies the reference potential and which is common to all pixels. The p-type driving transistor 121*p* has a drain terminal thereof connected to a first potential Vss on a low voltage side. The p-type driving transistor 121*p* feeds a driving current Ids for making the organic EL element 127 emit light.

An organic EL display device according to the example of modification in which the driving transistor 121 is changed to a p-type by applying such a duality principle can perform threshold value correcting operation, mobility correcting operation, and bootstrap operation as with the organic EL display device using the n-type driving transistor 121.

In driving such a pixel circuit P, as in the first to fourth embodiments described above, the sampling transistor is formed into a double-gate structure, and while a first sampling transistor 125 of the double-gate structure is scanned by an ordinary writing driving pulse WS, a second sampling transistor 625 is controlled by using, as a sampling control signal SC, a writing driving pulse WS or a power driving pulse DSL of other than a group of a plurality of rows sharing a writing scanning line 104WS (writing driving pulse WS). Thereby, as in the foregoing embodiments, it is possible to reduce the number of writing scanning lines 104WS as scanning lines for supplying writing driving pulses WS to the gates of sampling transistors 125 and thus achieve cost reduction without increasing the number of control signals output from a vertical driving unit 103 (a scanner or a driver) and without having additional control circuits or control lines on the outside.

It is to be noted that while the example of modification of the pixel circuit P as described above is obtained by making changes following the "duality principle" to the configurations shown in the foregoing first to fourth embodiments, a method of changing the circuit is not limited to this. The number of transistors forming the pixel circuit P is arbitrary as long as in performing threshold value correcting operation, driving is performed such that the video signal Vsig changing between the offset potential Vofs and the signal potential Vin (=Vofs+ΔVin) within each horizontal period according to scanning by the writing scanning section 104 is transmitted to the video signal line 106HS, and the drain side (power supply side) of the driving transistor 121 is switching-driven between the first potential and the second potential for the initializing operation of threshold value correction. It does not matter whether the pixel circuit P is of the 2TR configuration or not, and the number of transistors may be three or more. The concept of the present embodiments of achieving cost reduction by applying the improving methods of the present embodiments described above in which the sampling transistor is formed into a double-gate structure and thereby reducing the number of writing scanning lines 104WS (writing driving pulses WS) can be applied to all of those configurations.

In addition, the mechanism of supplying the offset potential Vofs and the signal potential Vin to the gate of the driving transistor 121 in performing threshold value correcting operation is not limited to making provision by the video signal Vsig as in the 2TR configuration of the foregoing embodiments. For example, a mechanism of supplying the offset potential Vofs and the signal potential Vin via another transistor as described in Patent Document 1 can be adopted as the mechanism of supplying the offset potential Vofs and the signal potential Vin to the gate of the driving transistor 121. Also in these examples of modification, the concept of the present embodiments of achieving cost reduction by applying the improving methods of the present embodiments described above in which the sampling transistor is formed into a double-gate structure and thereby reducing the number of video signal lines 106HS (video signals Vsig) can be applied.

The present application contains subject matter related to that disclosed in Japanese Priority Patent Application JP 2008-165203 filed in the Japan Patent Office on Jun. 25, 2008, the entire content of which is hereby incorporated by reference.

It should be understood by those skilled in the art that various modifications, combinations, sub-combinations and alterations may occur depending on design requirements and other factor in so far as they are within the scope of the appended claims or the equivalents thereof.

What is claimed is:

1. A display device comprising:

a horizontal scanning section configured to supply signal potentials to signal lines, the signal potentials including video signal potentials;

pixel circuits arranged in rows and columns, a plurality of the pixel circuits being grouped into groups of k rows, k>2, respective ones of the pixel circuits including a storage capacitor, a first sampling transistor and a second sampling transistor that are cascaded and together control writing of the signal potentials from one of the signal lines to the storage capacitor, a driving transistor that generates a driving current based on a voltage held in the storage capacitor, and an electrooptic element connected to an output terminal of the driving transistor;

a vertical scanning section configured to supply vertical scanning pulses for vertical scanning of the pixels circuits to row scanning lines that include writing scanning lines and power supply scanning lines, wherein each of the writing scanning lines corresponds to one of the groups and is connected in common to a gate electrode of the first sampling transistor of each of the pixel circuits of the corresponding group, each power supply scanning line corresponds to one of the groups and controls supply of power to the driving transistor of each of the pixel circuits of one or more rows of the respective corresponding group, for each of the groups: a gate electrode of the second sampling transistor of each of the pixel circuits in one of the k rows of the respective group is connected to one of the power supply scanning lines that corresponds to a different one of the groups than the respective group and a gate electrode of the second sampling transistor of each of the pixel circuits in one of the other k rows of the respective group is connected to one of the writing scanning lines that corresponds to another different one of the groups than the different one of the groups and the respective group, and the vertical scanning section supplies the vertical scanning pulses to the row scanning lines such that a threshold correction operation is performed in each of the pixel circuits, and, for each of the pixel circuits, a delay between a last threshold correction operation for the respective pixel circuit in a given period and a video signal writing operation for the respective pixel circuit in the given period is the same in each of the pixel circuits.

2. The display device of claim 1, wherein the vertical scanning section supplies vertical scanning pulses to the row scanning lines such that in each given period the threshold correction operation is performed the same number of times in each of the pixel circuits.

3. The display device of claim 1, wherein the vertical scanning section supplies vertical scanning pulses to the row scanning lines such that in each given period a duration of an emission period of each of the pixel circuits is the same.

4. The display device of claim 1, wherein each of the power supply lines controls supply of power to the respective driving transistors of all of the pixel circuits in the corresponding group.

5. The display device of claim 1, wherein the horizontal scanning section line-sequentially supplies the video signal potentials to the signal lines for each row in order, and the vertical scanning section supplies the vertical scanning pulses such that, when the video signal potentials for a given row are supplied to the signal lines, the first and second transistors of each pixel circuit of the given row are conductive and the second transistor of all of the other pixel circuits in the group that includes the given row are not conductive.

6. The display device of claim 1, wherein the vertical scanning section supplies the vertical scanning pulses such that a pattern of display states of each of the pixel circuits is the same.

7. The display device of claim 1, wherein an input terminal of the driving transistor of each of the pixel circuits is connected to one of the power supply scanning lines and the vertical scanning pulses include power supply pulses supplied to the power supply scanning lines, the power supply pulses including a driving voltage for producing the driving current in the driving transistors.

8. The display device of claim 1, wherein each of the pixel circuits includes a current path between a driving voltage supply line and the electrooptic element of the respective pixel circuit via the driving transistor of the respective pixel circuit, each of the pixel circuit includes a switching transistor interposed in the current path between the driving voltage supply line and the electrooptic element of the respective pixel circuit, and the gate electrode of the switching transistor of each of the pixel circuits connected to one of the power supply scanning lines and the vertical scanning pulses include power supply pulses supplied to the power supply scanning lines, the power supply pulses including ON and OFF voltages for the switching transistors.

9. The display device of claim 1, wherein the vertical scanning pulses include power supply pulses supplied to the power supply scanning lines, the power supply pulses switching between a first potential and a second potential, the first potential being supplied to the power supply scanning lines when the one or more rows that the respective power supply scanning line controls power supply to is driven to emit light, and the vertical scanning section is configured to extinguish light emission of a given row by causing the first and second sampling transistors of the pixel circuits of the given row to conduct while a reference potential is supplied as the signal potential on the signal lines and while the first potential is supplied to the power supply scanning line that controls power supply to the given row.

10. The display device of claim 1, wherein the vertical scanning pulses include power supply pulses supplied to the power supply scanning lines, the power supply pulses switching between a first potential and a second potential, the first potential being supplied to the power supply scanning lines when the one or more rows that the respective power supply scanning line controls power supply to is driven to emit light, and the vertical scanning section is configured to perform the threshold correction operation for a given row by causing the first and second sampling transistors of the pixel circuits of the given row to conduct while a reference potential is supplied as the signal potential on the signal lines and while the first potential is supplied to the power supply scanning line that controls power supply to the given row.

11. An electronic apparatus comprising the display device of claim 1.

* * * * *